US007478555B2

(12) United States Patent
Zhan et al.

(10) Patent No.: US 7,478,555 B2
(45) Date of Patent: Jan. 20, 2009

(54) TECHNIQUE AND APPARATUS FOR USE IN WELL TESTING

(75) Inventors: Lang Zhan, Pearland, TX (US); James G. Filas, Sugar Land, TX (US); Dhandayuthapani Kannan, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 144 days.

(21) Appl. No.: 11/211,892

(22) Filed: Aug. 25, 2005

(65) Prior Publication Data

US 2007/0050145 A1 Mar. 1, 2007

(51) Int. Cl.
*E21B 47/08* (2006.01)

(52) U.S. Cl. ..... 73/152.55; 73/152.01; 73/152.54

(58) Field of Classification Search ..... 73/152.55, 73/152.01, 152.54
See application file for complete search history.

(56) References Cited

U.S. PATENT DOCUMENTS 3,217,804 A * 11/1965 Peter ..... 175/4
4,423,625 A 1/1984 Bostic, III
4,797,821 A 1/1989 Petak
4,860,581 A 8/1989 Zimmerman et al.
4,915,168 A 4/1990 Upchurch
5,186,048 A * 2/1993 Foster et al. ..... 73/152.02
5,375,658 A * 12/1994 Schultz et al. ..... 166/250.01
5,826,662 A 10/1998 Beck et al.
6,041,860 A * 3/2000 Nazzal et al. ..... 166/250.01
6,109,372 A * 8/2000 Dorel et al. ..... 175/61
6,173,772 B1 1/2001 Vaynshteyn
6,446,720 B1 9/2002 Ringgenberg et al.
6,598,682 B2 7/2003 Johnson et al.
6,622,554 B2 9/2003 Manke et al.
7,062,958 B2 * 6/2006 Diakonov et al. ..... 73/152.23
7,114,385 B2 * 10/2006 Fisseler et al. ..... 73/152.26
RE39,583 E * 4/2007 Upchurch ..... 166/250.15
2003/0033866 A1 * 2/2003 Diakonov et al. ..... 73/152.55
2003/0225522 A1 12/2003 Poe

FOREIGN PATENT DOCUMENTS

EP 0295923 A3 12/1988

* cited by examiner

*Primary Examiner*—Daniel S Larkin
*Assistant Examiner*—Rodney T Frank
(74) *Attorney, Agent, or Firm*—Kevin B. McGoff; Trop, Pruner + Hu, P.C.; James L. Kurka

(57) ABSTRACT

A technique that is usable with a well includes communicating fluid from the well into a downhole chamber in connection with a well testing operation. The technique includes monitoring a downhole parameter that is responsive to the communication to determine when to close the chamber.

32 Claims, 14 Drawing Sheets

TECHNIQUE AND APPARATUS FOR USE IN WELL TESTING

BACKGROUND

The invention generally relates to a technique and apparatus for use in well testing.

An oil and gas well typically is tested for purposes of determining the reservoir productivity and other key properties of the subterranean formation to assist in decision making for field development. The testing of the well provides such information as the formation pressure and its gradient; the average formation permeability and/or mobility; the average reservoir productivity; the permeability/mobility and reservoir productivity values at specific locations in the formation; the formation damage assessment near the wellbore; the existence or absence of a reservoir boundary; and the flow geometry and shape of the reservoir. Additionally, the testing may be used to collect representative fluid samples at one or more locations.

Various testing tools may be used to obtain the information listed above. One such tool is a wireline tester, a tool that withdraws only a small amount of the formation fluid and may be desirable in view of environmental or tool constraints. However, the wireline tester only produces results in a relatively shallow investigation radius; and the small quantity of the produced fluid sometimes is not enough to clean up the mud filtrate near the wellbore, leading to unrepresentative samples being captured in the test.

Due to the limited capability of the wireline tester, testing may be performed using a drill string that receives well fluid. As compared to the wireline tester, the drill string allows a larger quantity of formation fluid to be produced in the test, which, in turn, leads to larger investigation radius, a better quality fluid sample and a more robust permeability estimate. In general, tests that use a drill string may be divided into two categories: 1.) tests that produce formation fluid to the surface (called "drill stem tests" (DSTs)); and 2.) tests that do not flow formation fluid to the surface but rather, flow the formation fluid into an inner chamber of the drill string (called "closed chamber tests" (CCTs), or "surge tests").

For a conventional DST, production from the formation may continue as long as required since the hydrocarbon that is being produced to the surface is usually flared via a dedicated processing system. The production of this volume of fluid ensures that a clean hydrocarbon is acquired at the surface and allows for a relatively large radius of investigation. Additionally, the permeability calculation that is derived from the DST is also relatively simple and accurate in that the production is usually maintained at a constant rate by means of a wellhead choke. However, while usually providing relatively reliable results, the DST typically has the undesirable characteristic of requiring extensive surface equipment to handle the produced hydrocarbons, which, in many situations, poses an environmental handling hazard and requires additional safety precautions.

In contrast to the DST, the CCT is more environmentally friendly and does not require expensive surface equipment because the well fluid is communicated into an inner chamber (called a "surge chamber") of the drill string instead of being communicated to the surface of the well. However, due to the downhole confinement of the fluid that is produced in a CCT, a relatively smaller quantity of fluid is produced in a CCT than in a DST. Therefore, the small produced fluid volume in a CCT may lead to less satisfactory wellbore cleanup. Additionally, the mixture of completion, cushion and formation fluids inside the wellbore and the surge chamber may deteriorate the quality of any collected fluid samples. Furthermore, in the initial part of the CCT, a high speed flow of formation fluid (called a "surge flow") enters the surge chamber. The pressure signal (obtained via a chamber-disposed pressure sensor) that is generated by the surge flow may be quite noisy, thereby affecting the accuracy of the formation parameters that are estimated from the pressure signal.

Thus, there exists a continuing need for a better technique and/or system to perform a closed chamber test in a well.

SUMMARY

In an embodiment of the invention, a technique that is usable with a well includes communicating fluid from the well into a downhole chamber in connection with a well test. The technique includes monitoring a downhole parameter that is responsive to the communication to determine when to close the chamber.

In another embodiment of the invention, a system that is usable with a well includes a tubular member, a valve and a circuit. The tubular member includes a chamber. The valve is disposed in the tubular member to control fluid flow from the well into the chamber in connection with a well testing operation. The circuit receives an indication of a measurement of a downhole parameter responsive to the fluid flow and controls the valve to selectively close the valve in response to the measurement.

Advantages and other features of the invention will become apparent from the following description, drawing and claims.

DETAILED DESCRIPTION

Figure 1:
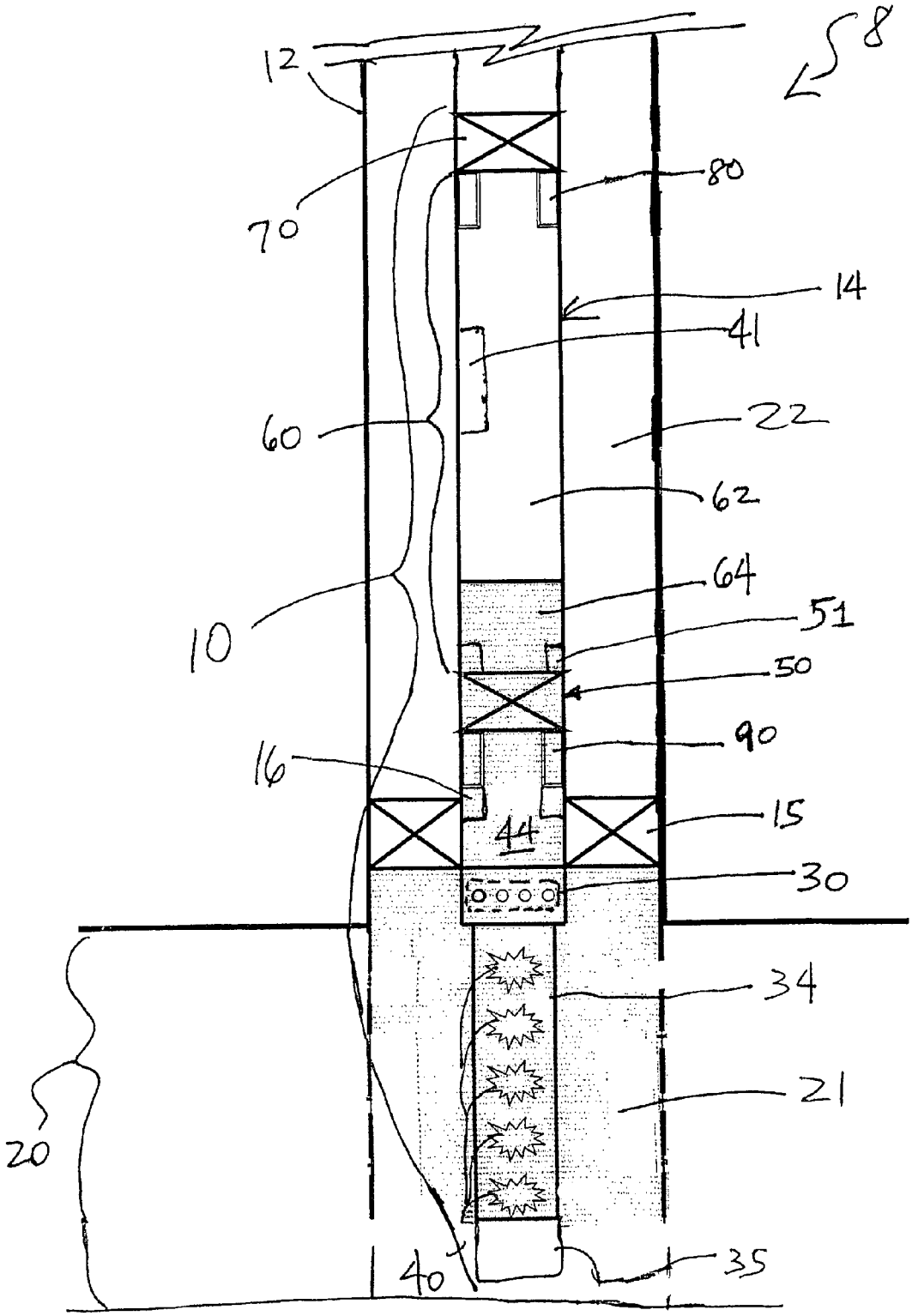
FIG. 1 is a schematic diagram of a closed chamber testing system before a bottom valve of the system is open and a closed chamber test begins, according to an embodiment of the invention.

Referring to FIG. 1, as compared to a conventional closed chamber testing (CCT) system, a CCT system 10 in accordance with an embodiment of the invention obtains more accurate bottom hole pressure measurements, thereby leading to improved estimation of formation property parameters of a well 8 (a subsea well or a non-subsea well). The CCT system 10 may also offer an improvement over results obtained from wireline testers or other testing systems that have more limited radii of investigation. Additionally, as described below, the CCT system 10 may provide better quality fluid samples for pressure volume temperature (PVT) and flow assurance analyses.

The design of the CCT system 10 is based on at least the following findings. During a closed chamber test using a conventional CCT system, the formation fluid is induced to flow into a surge chamber and the test is terminated sometime after the wellbore pressure and formation pressure reach equilibrium. Occasionally, a shut-in at the lower portion of the surge chamber is implemented after pressure equilibrium has been reached, in order to conduct other operations, but there is no method to determine an appropriate shut-in time in a conventional CCT system. The pressure in the CCT system's surge chamber has a strong adverse effect on the bottom hole pressure (BHP) measurement, thereby making the interpretation of formation properties from the BHP data inaccurate. However, it has been discovered that the surge chamber pressure effect on the BHP may be eliminated, in accordance with the embodiments of the invention described herein, by shutting in, or closing, the surge chamber to isolate the chamber from the BHP at the appropriate time (herein called the "optimal time" and further described below).

The optimal time is reached when the surge chamber is almost full while the BHP is still far from equilibrium with formation pressure. The signature of this optimal time can be identified by a variety of ways (more detailed description of the optimal time is given in the following). Additionally, as further described below, closing the surge chamber at the optimal time enables the well test to produce almost the full capacity of the chamber to improve clean up of the formation and expand the radius of investigation into the formation, as compared to conventional CCTs. After the bottom valve of the surge chamber is shut-in, the upper surge chamber does not adversely affect the quality of the recorded pressure at a location below the bottom valve. The pressure thusly measured below the bottom valve during this shut-in time is superior for inferring formation properties. The various embodiments of this invention described herein are generally geared toward determining this optimal time and controlling the various components in the system accordingly in order to realize improved test results.

Turning now to the more specific details of the CCT system 10, in accordance with some embodiments of the invention, the CCT system 10 is part of a tubular string 14, such as drill string (for example), which extends inside a wellbore 12 of the well 8. The tubular string 14 may be a tubing string other than a drill string, in other embodiments of the invention. The wellbore 12 may be cased or uncased, depending on the particular embodiment of the invention. The CCT system 10 includes a surge chamber 60, an upper valve 70 and a bottom valve 50. The upper valve 70 controls fluid communication between the surge chamber 60 and the central fluid passageway of the drill string 14 above the surge chamber 60; and the bottom valve 50 controls fluid communication between the surge chamber 60 and the formation. Thus, when the bottom valve 50 is closed, the surge chamber 60 is closed, or isolated, from the well.

FIG. 1 depicts the CCT system 10 in its initial state prior to the CCT (herein called the "testing operation"). In this initial state, both the upper 70 and bottom 50 valves are closed. The upper valve 70 remains closed during the testing operation. As further described below, the CCT system 10 opens the bottom valve 50 to begin the testing operation and closes the bottom valve 50 at the optimal time to terminate the surge flow and isolate the surge chamber from the bottom-hole wellbore. As depicted in FIG. 1, in accordance with some embodiments of the invention, prior to the testing operation, the surge chamber 60 may include a liquid cushion layer 64 that partially fills the chamber 60 to leave an empty region 62 inside the chamber 60. It is noted that the region 62 may be filled with a gas (a gas at atmospheric pressure, for example) in the initial state of the CCT system 10 (prior to the CCT), in accordance with some embodiments of the invention.

For purposes of detecting the optimal time to close the bottom valve 50, the CCT system 10 measures at least one downhole parameter that is responsive to the flow of well fluid into the surge chamber 60 during the testing operation. In accordance with the various embodiments of the invention, one or more sensors can be installed anywhere inside the surge chamber 60 or above the surge chamber in the tubing 14 or in the wellbore below the valve 50, provided these sensors are in hydraulic communication with the surge chamber or wellbore below the valve 50. As a more specific example, the CCT system 10 may include an upper gauge, or sensor 80, that is located inside and near the top of the surge chamber 60 for purposes of measuring a parameter inside the chamber 60. In accordance with some embodiments of the invention, the upper sensor 80 may be a pressure sensor to measure a chamber pressure (herein called the "CHP"), a pressure that exhibits a behavior (as further described below) that may be monitored for purposes of determining the optimal time to close the bottom valve 50. The sensor 80 is not limited to being a pressure sensor, however, as the sensor 80 may be one of a variety of other non-pressure sensors, as further described below.

The CCT system 10 may include at least one additional and/or different sensor than the upper sensor 80, in some embodiments of the invention. For example, in some embodiments of the invention, the CCT system 10 includes a bottom gauge, or sensor 90, which is located below the bottom valve 50 (and outside of the surge chamber 60) to sense a parameter upstream of the bottom valve 50. More specifically, in accordance with some embodiments of the invention, the bottom sensor 90 is located inside an interior space 44 of the string 14, a space that exists between the bottom valve 50 and radial ports 30 that communicate well fluid from the formation to the surge chamber 60 during the testing operation. The sensor 90 is not restricted to interior space 44, as it could be anywhere below valve 50 in the various embodiments of the invention.

In some embodiments of the invention, the bottom sensor 90 is a pressure sensor that provides an indication of a bottom hole pressure (herein called the "BHP"); and as further described below, in some embodiments of the invention, the CCT system 10 may monitor the BHP to determine the optimal time to close the bottom valve 50.

Determining the optimal time to close the bottom valve 50 and subsequently extract formation properties may be realized either via the logged data from a single sensor, such as the bottom sensor 90, or from multiple sensors. If the bottom sensor 90 has the single purpose of determining the optimal valve 50 closure time, the sensor 90 may be located above or below the bottom valve 50 in any location inside the surge chamber 60 or string space 44 without compromising its capability, although placement inside space 44 below the bottom valve 50 is preferred in some embodiments of the invention. However, in any situation, at least one sensor is located below the bottom valve 50 to log the wellbore pressure for extracting formation properties. In the following description, the bottom sensor 90 is used for both determining optimal time to close the bottom valve 50 and logging bottom wellbore pressure history for extracting formation properties, although different sensor(s) and/or different sensor location (s) may be used, depending on the particular embodiment of the invention.

Thus, the upper 80 and/or bottom 90 sensor may be used either individually or simultaneously for purposes of monitoring a dynamic fluid flow condition inside the wellbore to time the closing of the bottom valve 50 (i.e., identify the "optimal time") to end the flowing phase of the testing operation. More specifically, in accordance with some embodiments of the invention, the CCT system 10 includes electronics 16 that receives indications of measured parameter(s) from the upper 80 and/or lower 90 sensor. As a more specific example, for embodiments of the invention in which the upper 80 and lower 90 sensors are pressure sensors, the electronics 16 monitors at least one of the CHP and the BHP to recognize the optimal time to close the bottom valve 50. Thus, in accordance with the some embodiments of the invention, the electronics 16 may include control circuitry to actuate the bottom valve 50 to close the valve 50 at a time that is indicated by the BHP or CHP exhibiting a predetermined characteristic. Alternatively, in some embodiments of the invention, the electronics 16 may include telemetry circuitry for purposes of communicating indications of the CHP and/or BHP to the surface of the well so that a human operator (or a computer, as another example) may monitor the measured parameter(s) and communicate with the electronics 16 to close the bottom valve 50 at the appropriate time.

It is noted that the CHP and/or BHP may be logged by the CCT system 10 (via a signal that is provided by the sensor 80 and/or 90) during the CCT testing operation for purposes of allowing key formation properties to be extracted from the CCT.

Therefore, to summarize, in some embodiments of the invention, the CCT system 10 may include electronics 16 that monitors one or more parameters that are associated with the testing operation and automatically controls the bottom valve 50 accordingly; and in other embodiments of the invention, the bottom valve 50 may be remotely controlled from the surface of the well in response to downhole measurements that are communicated uphole. The remote control of the bottom valve 50 may be achieved using any of a wide range of wireless communication stimuli, such as pressure pulses, radio frequency (RF) signals, electromagnetic signals, or acoustic signals, as just a few examples. Furthermore, cable or wire may extend between the bottom valve 50 and the surface of the well for purposes of communicating wired signals between the valve 50 and the surface to control the valve 50. Other valves that are described herein may also be controlled from the surface of the well using wired or wireless signals, depending on the particular embodiment of the invention. Thus, many variations are possible and are within the scope of the appended claims.

Among the other features of the CCT system 10, the CCT system 10 includes a packer 15 to form an annular seal between the exterior surface of the string 14 and the wellbore wall. When the packer 15 is set, a sealed testing region 20 is formed below the packer 15. When the bottom valve 50 opens to begin the testing operation, well fluid flows into the radial ports 30, through the bottom valve 50 and into the chamber 60. As also depicted in FIG. 1, in accordance with some embodiments of the invention, the CCT system 10 includes a perforation gun 34 and another surge apparatus 35 that is sealed off from the well during the initial deployment of the CCT system 10. Prior to the beginning of the testing operation, perforating charges may be fired or another technique may be employed to establish communication of fluid flow between formation 20 and a wellbore 21 for purposes of allowing fluid to flow into the gun 34 and surge apparatus 35. This inflow of fluid into the surge apparatus 35 prior to the testing operation permits better perforation and clean up. Depending on the particular embodiment of the invention, the surge apparatus 35 may be a waste chamber that, in general, may be opened at any time to collect debris, mud filtrate or non-formation fluids (as examples) to improve the quality of fluid that enters the surge chamber 60.

In other embodiments of the invention, the surge apparatus 35 may include a chamber and a chamber communication device to control when fluid may enter the chamber. More specifically, the opening of fluid communication between the chamber of the surge apparatus 35 and the wellbore 21 may be timed to occur simultaneously with a local imbalance to create a rapid flow into the chamber. The local imbalance may be caused by the firing of one or more shaped charges of the perforation gun 35, as further described in U.S. Pat. No. 6,598,682 entitled, "RESERVOIR COMMUNICATION WITH A WELLBORE," which issued on Jul. 29, 2003.

Figure 2:
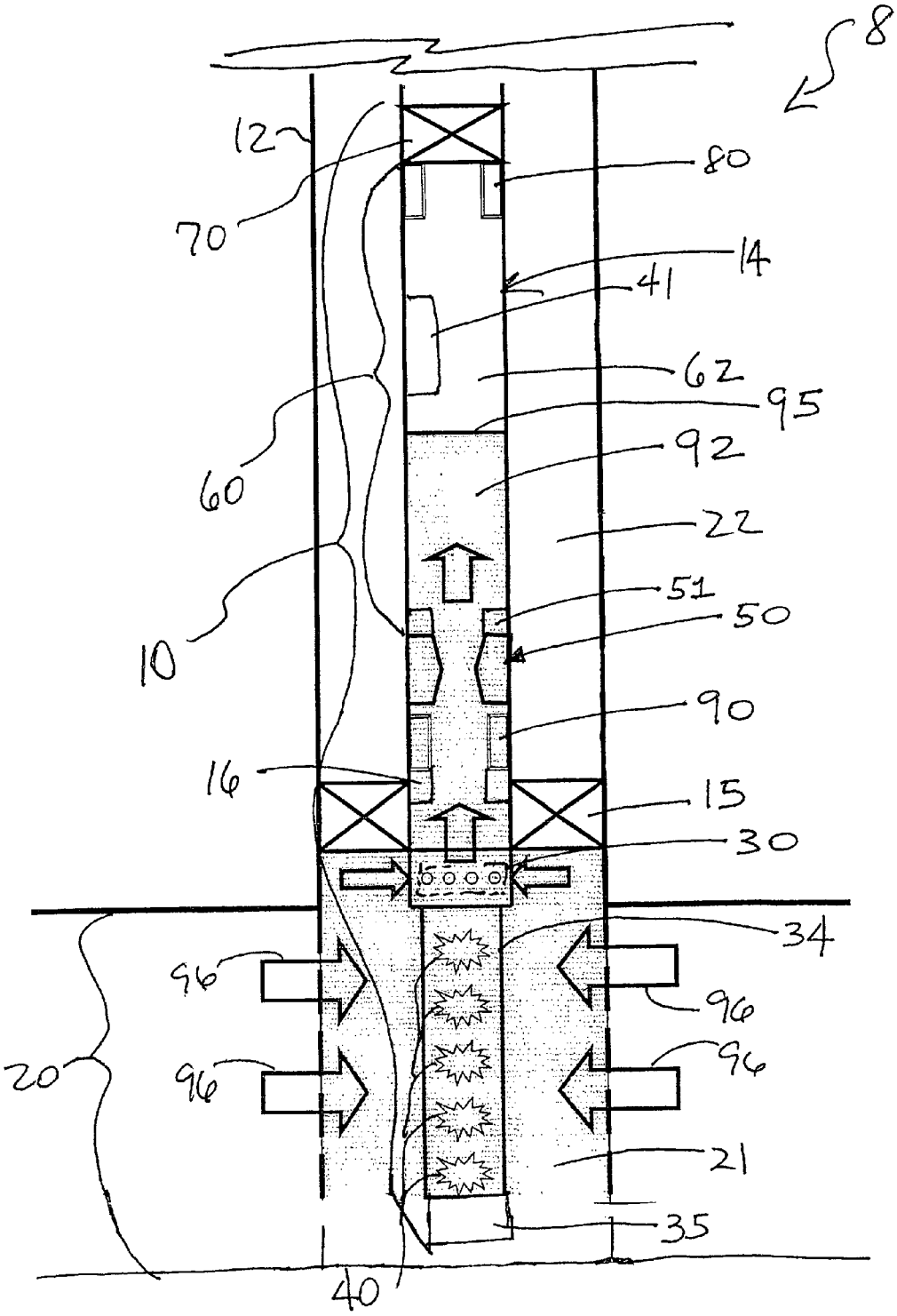
FIG. 2 is a schematic diagram of the closed chamber testing system illustrating the flow of well fluid into a surge chamber of the system during a closed chamber test according to an embodiment of the invention.

For purposes of capturing a representative fluid sample from the well, in accordance with some embodiments of the invention, the CCT system 10 includes a fluid sampler 41 that is in communication with the surge chamber 60, as depicted in FIG. 2. The fluid sampler 41 may be operated remotely from the surface of the well or may be automatically operated by the electronics 16, depending on the particular embodiment of the invention. The location of the fluid sampler 41 may vary, depending on the particular embodiment of the invention. For example, the fluid sample may be located below in the bottom valve 50 in the space 44, in other embodiments of the invention. Thus, many variations are possible and are within the scope of the appended claims.

FIG. 2 depicts the CCT system 10 during the CCT testing operation when the bottom valve 50 is open. As shown, well fluid flows through the radial ports 30, through the bottom valve 50 and into the surge chamber 60, thereby resulting in a flow 96 from the formation. As the well fluid accumulates in the surge chamber 60, a column height 95 of the fluid rises inside the chamber 60. Measurements from one or both of the sensors 80 and 90 may be monitored during the testing operation; and the fluid sampler 41 may be actuated at the appropriate time to collect a representative fluid sample. As further described below, at an optimal time indicated by one or more downhole measurements, the bottom valve 50 closes to end the fluid flow into the surge chamber 60.

After the surge flow ends, the sensor 90 below the bottom valve 50 continues to log wellbore pressure until an equilibrium condition is reached between the formation and the wellbore, or, a sufficient measurement time is reached. The data measured by sensor 90 contains less noise after the bottom-valve 50 closes, yielding a better estimation of formation properties. The fluid samples that are subsequently captured below the bottom valve 50 after its closure are of a higher quality because of their isolation from contamination due to debris and undesirable fluid mixtures that may exist in the surge chamber. After the test is completed, a circulating valve 51 and upper valve 70 are opened. The produced liquid in the surge chamber can be circulated out by injecting a gas from the wellhead through pipe string 14 or a wellbore annulus 22 above the packer 15. The entire surge chamber can then be reset to be able to conduct another CCT test again. This sequence may be repeated as many times as required.

Figure 3:
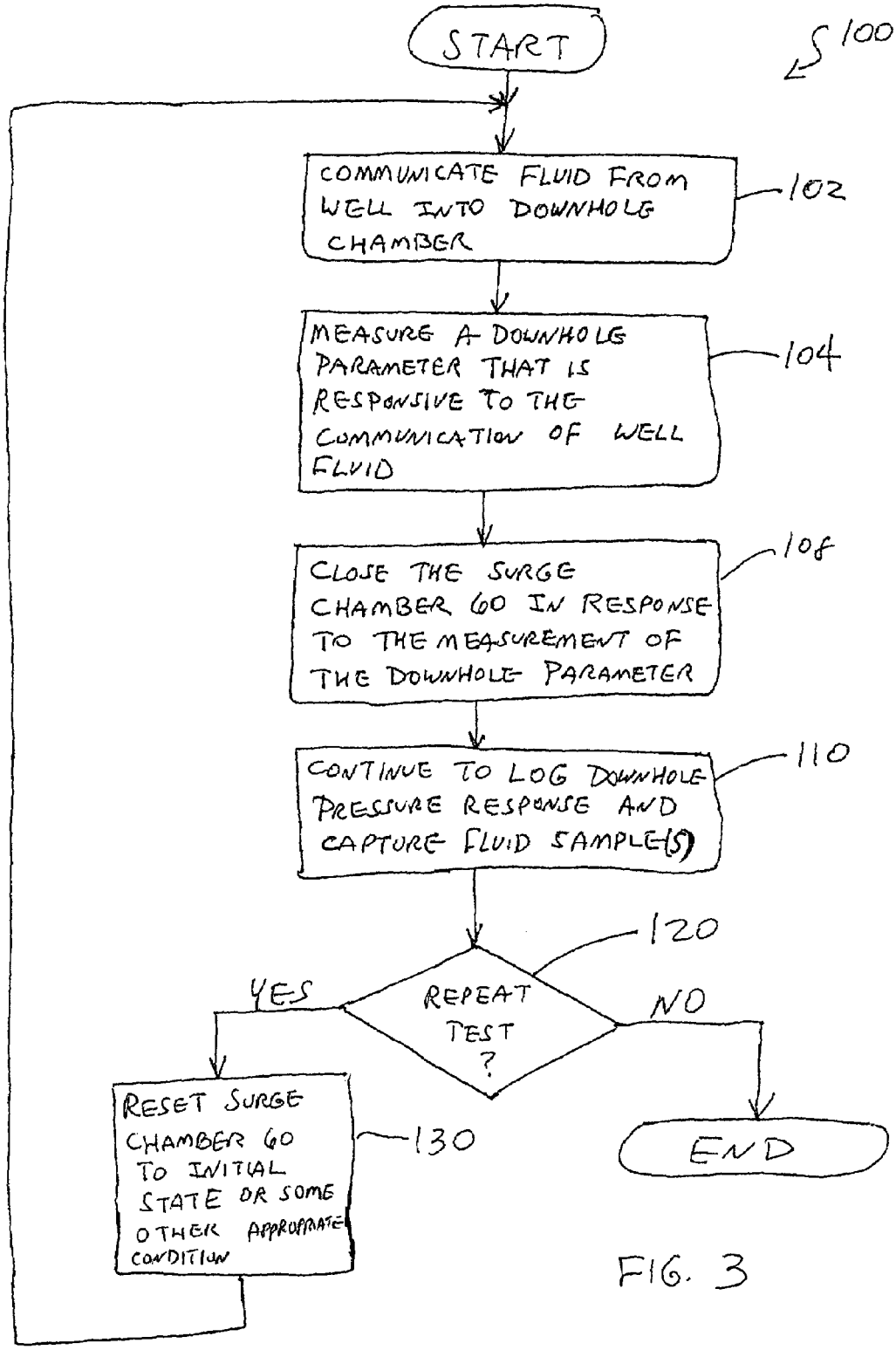
FIG. 3 is a flow diagram depicting a technique to isolate the surge chamber of the closed chamber testing system from the formation at the conclusion of the closed chamber test according to an embodiment of the invention.

To summarize, the CCT system 10 may be used in connection with a technique 100 that is generally depicted in FIG. 3. Pursuant to the technique 100, fluid is communicated from the well into a downhole chamber, pursuant to block 102. A downhole parameter that is responsive to this communication of well fluid is monitored, as depicted in block 104. A determination is made (block 108) when to close, or isolate, the surge chamber 60 from the well, in response to the monitoring of the downhole parameter, as depicted in block 108. Thus, as examples, the bottom valve 50 may be closed in response to the monitored downhole parameter reaching a certain threshold or exhibiting a given time signature (as just a few examples), as further described below.

After the surge chamber 60 is closed, the BHP continues to be logged, and finally, one or more fluid samples are captured (using the fluid sampler 41), as depicted in block 110. A determination is then made (diamond 120) whether further testing is required, and if so, the surge chamber 60 is reset (block 130) to its initial state or some other appropriate condition, which may include, for example, circulating out the produced liquid inside the surge chamber 60 via the circulating valve 51 (see FIG. 2, for example). Thus, blocks 102-130 may be repeated until no more testing is needed.

Figure 4:
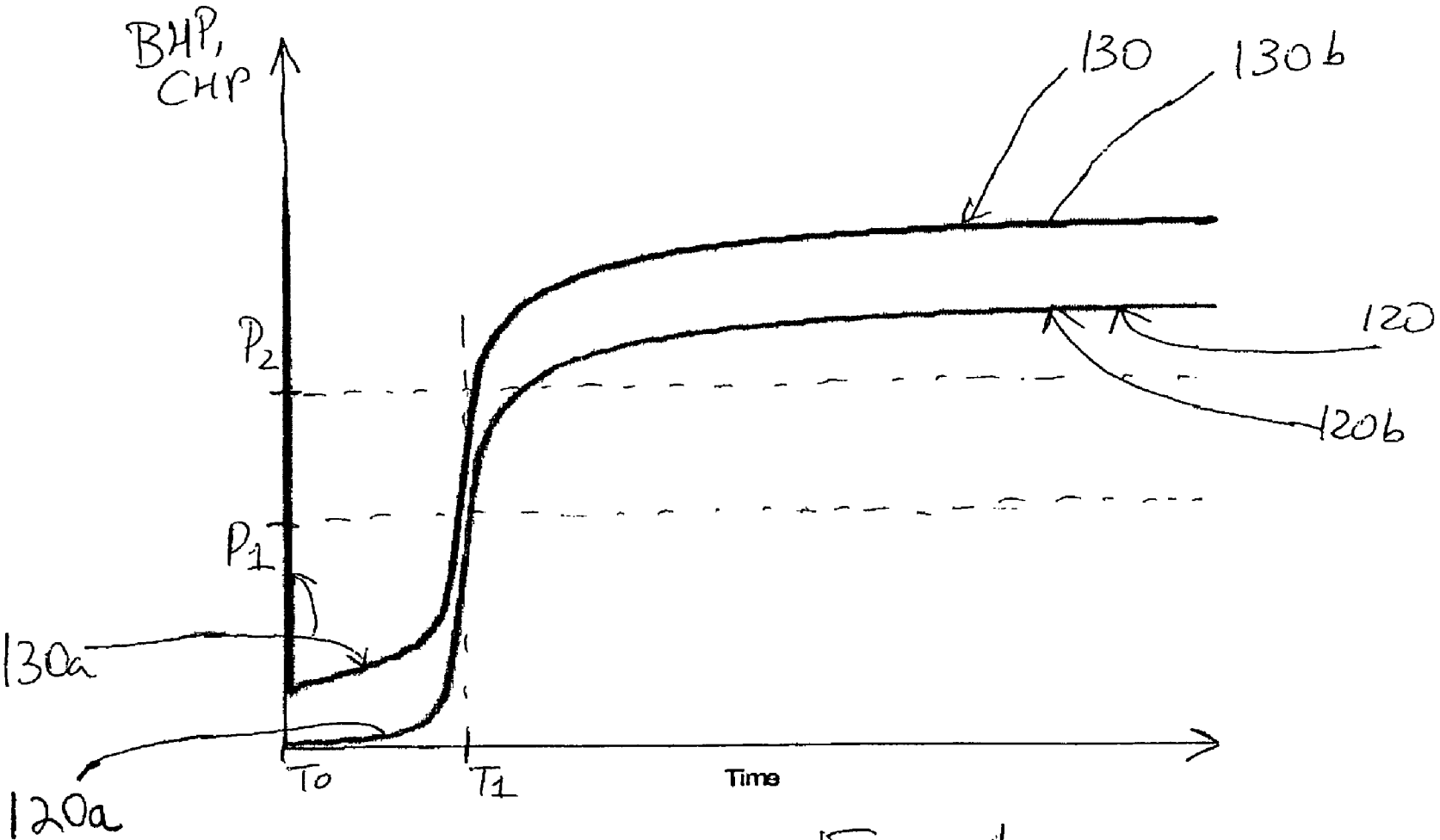
FIG. 4 depicts exemplary waveforms of a bottom hole pressure and a surge chamber pressure that may occur in connection with a closed chamber test according to an embodiment of the invention.

In some embodiments of the invention, the upper 80 and lower 90 sensors may be pressure sensors to provide indications of the CHP and BHP, respectively. For these embodiments of the invention, FIG. 4 depicts exemplary waveforms 120 and 130 for the CHP and BHP, respectively, which generally illustrate the pressures that may arise in connection with a CCT testing operation. Referring to FIG. 4, soon after the bottom valve 50 is open at time $T_0$ to begin the testing operation, the BHP waveform 130 decreases rapidly to a minimum pressure. Because as formation fluid flows into the surge chamber 60 the liquid column inside the chamber 60 rises, the BHP increases due to the increasing hydrostatic pressure at the location of the lower sensor 90. Therefore, as depicted in FIG. 4, the BHP waveform 130 includes a segment 130*a* during which the BHP rapidly decreases at time $T_0$ and then increases from approximately time $T_0$ to time $T_1$ due to the increasing hydrostatic pressure.

In addition to the hydrostatic pressure effect, other factors also have significant influences on the BHP, such as wellbore friction, inertial effects due to the acceleration of fluid, etc. One of the key influences on the BHP originates with the CHP that is communicated to the BHP through the liquid column inside the surge chamber 60. As depicted in FIG. 4 by a segment 120*a* of the CHP waveform 120, the CHP gradually increases during the initial testing period from time $T_0$ to time $T_1$. The gradual increase in the CHP during this period is due to liquid moving into the surge chamber 60, leading to the continuous shrinkage of the gas column 62 (see FIG. 2, for example). The magnitude of the CHP increase is approximately proportional to the reduction of the gas column volume based on the equation of state for the gas. However, as the testing operation progresses, the gas column 62 shrinks to such an extent that no more significant volume reduction of the column 62 is available to accommodate the incoming formation fluid. The CHP then experiences a dramatic growth since formation pressure starts to be passed onto the CHP via the liquid column.

More particularly, in the specific example that is shown in FIG. 4, the dramatic increase in the CHP waveform 120 occurs at time $T_1$, a time at which the CHP waveform 120 abruptly increases from the lower pressure segment 120*a* to a relatively higher pressure segment 120*b*. While the formation pressure acts on the CHP directly after time $T_1$, the reverse action is also true: the CHP affects the BHP. Thus, as depicted in FIG. 4, at time $T_1$, the BHP waveform 130 also abruptly increases from the lower pressure segment 130*a* to a relatively higher pressure segment 130*b*.

The CHP continuously changes during the testing operation because the gas chamber volume is constantly reduced, although with a much slower pace after the gas column can no longer be significantly compressed. Thus, as shown in FIG. 4, after time $T_1$, as illustrated by the segment 120*b*, the CHP waveform 120 increases at a much slower pace. Solution gas that was previously released from the liquid column may possibly re-dissolve back into the liquid, depending on the pressure difference between the CHP and the bubble point of produced liquid hydrocarbon. Therefore, conventional algorithms that do not properly account for the effect of the CHP on the BHP usually cannot provide a reliable estimate of formation properties. However, including all fluid transport and phase behavior phenomena in the gas chamber model is very complex. As described below, the CCT system 10 closes the bottom valve 50 to prevent the above-described dynamics of the CHP from affecting the BHP, thereby allowing the use of a relatively non-complex model to accurately estimate the formation properties.

More specifically, in accordance with some embodiments of the invention, the optimal time to close the bottom valve 50 is considered to occur when two conditions are satisfied: 1.) the surge chamber 60 is almost full of liquid and virtually no more formation fluid is able to move into the chamber 60; and 2.) the BHP is still much lower than the formation pressure.

In accordance with some embodiments of the invention, the optimal time for closing the bottom valve 50 occurs at the transition time at which the CHP is no longer generally proportional to the reduction of the gas column and significant non-linear effects come into play to cause a rapid increase in the CHP. At this time, the BHP also rapidly increases due to the communication of the CHP pressure through the liquid column. As further described in the following, this optimal time also corresponds to the filling of the surge chamber to its approximate maximum capacity, which is then indicated by a variety of dynamic fluid transport signatures. Thus, referring to the example that is depicted in FIG. 4, the optimal time is a time near time $T_1$ (i.e., a time somewhere in a range between a time slightly before time $T_1$ and a time slightly after time $T_1$), the time at which the CHP and the BHP abruptly rise. Therefore, the CHP and/or BHP may be monitored to identify the optimal time to close the bottom valve 50 depending on the particular embodiment of the invention.

In accordance with some embodiments of the invention, the electronics 16 may measure the BHP (via the lower sensor 90) to detect when the BHP increases past a predetermined pressure threshold (such as the exemplary threshold called "$P_2$" in FIG. 4). Thus, the electronics 16 may, during the testing operation, continually monitor the BHP and close the bottom valve 50 to shut-in, or isolate, the surge chamber 60 from the formation in response to the BHP exceeding the predetermined pressure threshold.

Alternatively, in some embodiments of the invention, the electronics 16 may monitor the CHP to determine when to close the bottom valve 50. Thus, in accordance with some embodiments of the invention, the electronics 16 monitors the CHP (via the upper sensor 80) to determine when the CHP exceeds a predetermined pressure threshold (such as the exemplary threshold called "$P_1$" in FIG. 4); and when this threshold crossing is detected, the electronics 16 actuates the bottom valve 50 to close or isolate, the surge chamber 60 from the formation.

As discussed above, the pressure magnitude change in the CHP is greater than the pressure magnitude change in the BHP when the substantial non-linear effects begin. Thus, by monitoring the CHP instead of the BHP to identify the optimal time to close the bottom valve 50, a larger signal change (indicative of the change of the CHP) may be used, thereby resulting in a larger signal-to-noise (S/N) ratio for signal processing. However, a possible disadvantage in using the CHP versus the BHP is that the surge chamber 60 may be relatively long (on the order of several thousand feet, for example); and thus, relatively long range telemetry may be needed to communicate a signal from the upper sensor 80 (located near the top end of the surge chamber 60 in some embodiments of the invention) to the electronics 16 (located near the bottom end of the surge chamber in some embodiments of the invention).

The CHP and BHP that are measured by the sensors 80 and 90 are only two exemplary parameters that may be used to identify the optimal time to close the bottom valve 50. For example, a sensor that is located at any place inside the surge chamber 60, space 44, or bottom hole wellbore 21 may also be used for this purpose without compromising the spirit of this invention. Depending on the location of the sensor, the measured pressure history will either more closely match that of sensor 80 or sensor 90.

Figure 5:
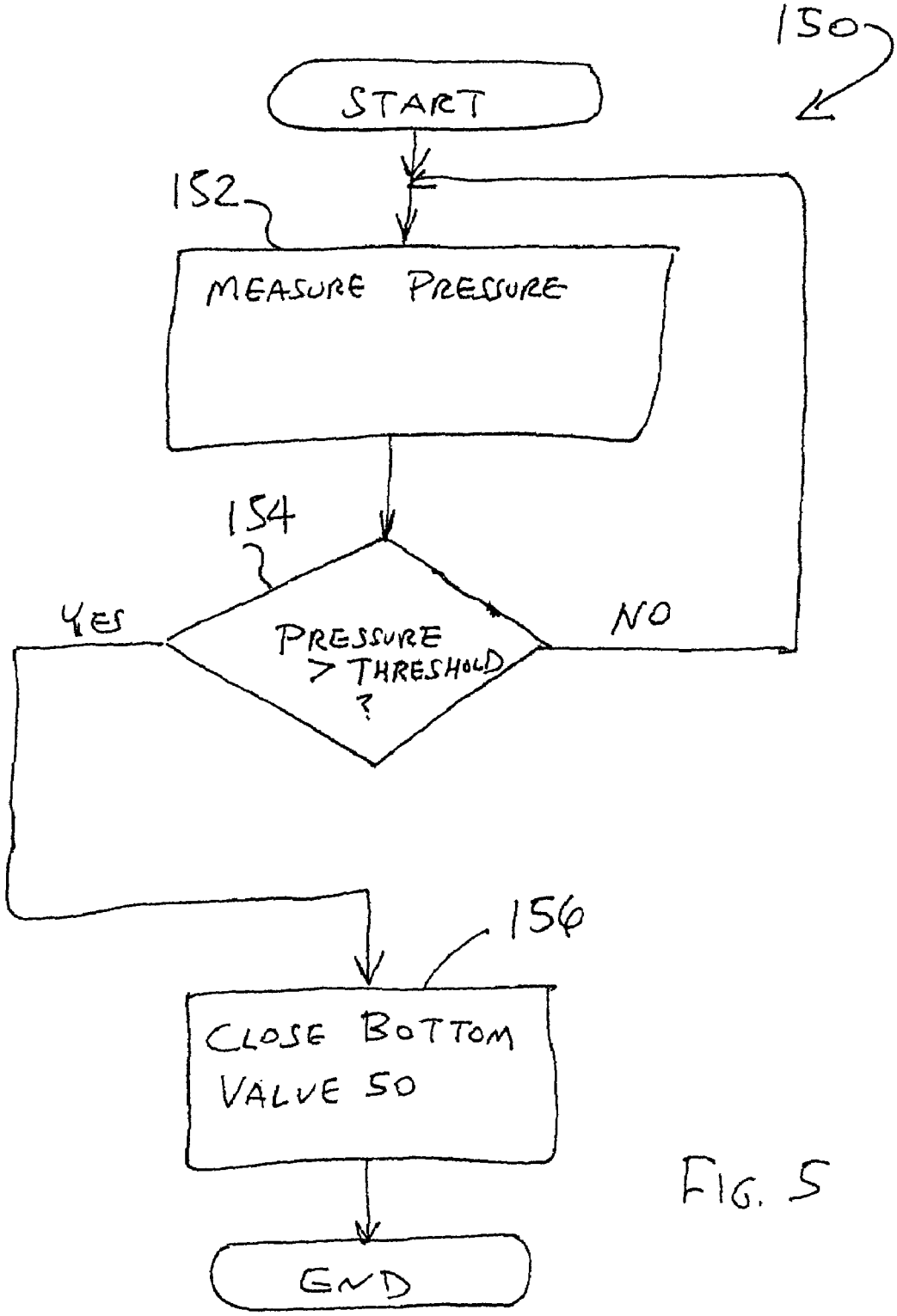
FIG. 5 is a flow diagram depicting a technique to use a measured pressure to time the closing of a bottom valve of the closed chamber testing system to end a closed chamber test according to an embodiment of the invention.

Regardless of the pressure that is monitored, a technique 150 (that is generally depicted in FIG. 5) may be used, in accordance with some embodiments of the invention, to control the bottom valve 50 during a CCT testing operation. Referring to FIG. 5, pursuant to the technique 150, a pressure (the BHP or CHP, as examples) is monitored during the CCT testing operation, as depicted in block 152. A determination (diamond 154) is made whether the pressure has exceeded a predetermined threshold. If not, then the pressure monitoring continues (block 152). Otherwise, if the measured pressure exceeds the predetermined threshold, then the bottom valve 50 is closed (block 156).

FIG. 5 depicts the aspects of the CCT related to the determining the optimal time to close the bottom valve 50. Although not depicted in the figures, the technique 150 as well as the alternative CCT testing operations that are described below, may include, after the closing of the bottom valve 50, continued logging of the downhole pressure (such as the BHP), the collection of one or more fluid samples, reinitialization of the surge chamber 60 and subsequent iterations of the CCT.

As mentioned above, many variations and embodiments of the invention are possible. For example, the bottom valve 50 may be controlled, pursuant to the technique 150, remotely from the surface of the well instead of automatically being controlled using the downhole electronics 16.

Other techniques in accordance with the many different embodiments of the invention may be used to detect the optimal time to close the bottom valve 50. For example, in other embodiments of the invention, the time derivative of either the CHP or BHP may be monitored for purposes of determining the optimal time to close the bottom valve 50. As a more specific example, referring to FIG. 6 in conjunction with FIG. 4, FIG. 6 depicts a waveform 160 of the first order time derivative of the CHP waveform 120 (i.e., $$\frac{dCHP}{dt})$$

and a waveform 166 of the first order time derivative of the BHP waveform 130 (i.e., $$\frac{dBHP}{dt}).$$

Figure 6:
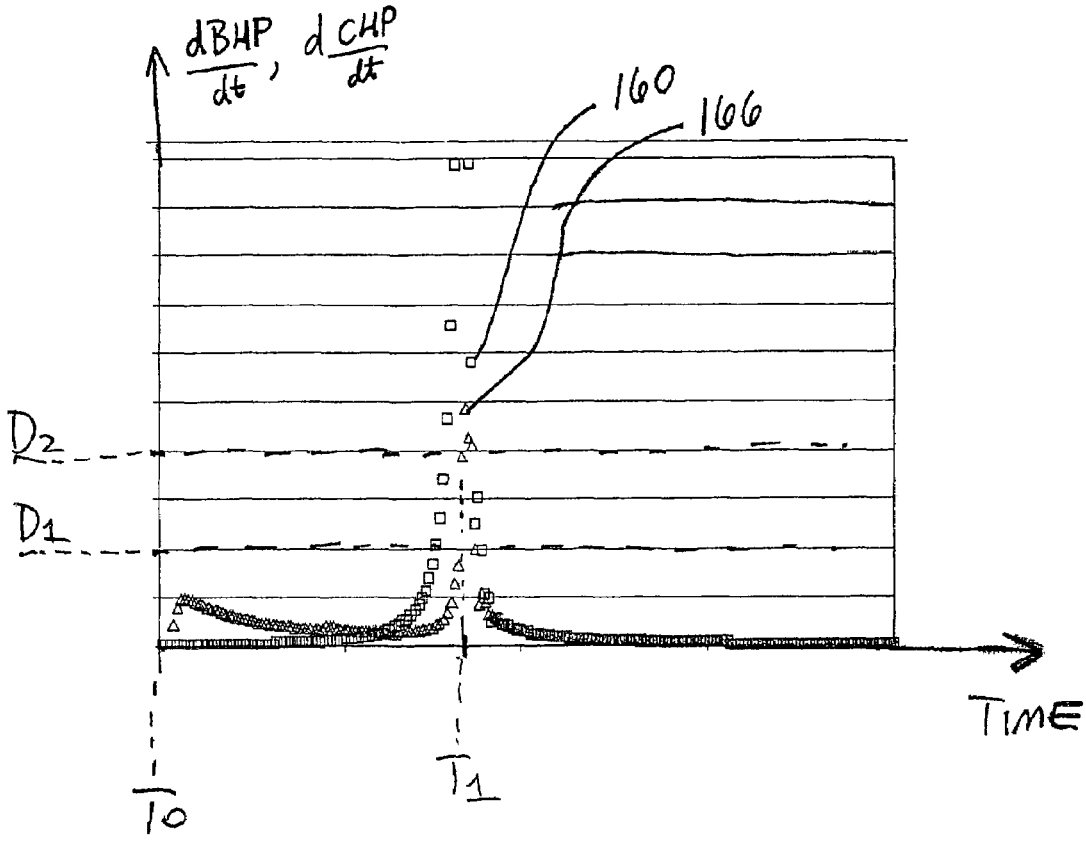
FIG. 6 depicts exemplary time derivative waveforms of a bottom hole pressure and a surge chamber pressure that may occur in connection with a closed chamber test according to an embodiment of the invention.

As shown in FIG. 6, at time $T_1$ (the optimum time for this example), the waveforms 160 and 166 contain rather steep increases, or "spikes." These spikes are attributable to the abrupt changes in the BHP 130 and CHP 120 waveforms at time $T_1$, as depicted in FIG. 4. Therefore, in accordance with some embodiments of the invention, the first order time derivative of either the CHP or the BHP may be monitored to determine if the derivative surpasses a predetermined threshold.

For example, in some embodiments of the invention, the first order time derivative of the CHP may be monitored to determine when the CHP surpasses a rate threshold (such as an exemplary rate threshold called "$D_2$" that is depicted in FIG. 6). Upon detecting that the first order time derivative of the CHP has surpassed the rate threshold, the electronics 16 responds to close the bottom valve 50.

In a similar manner, the electronics 16 may monitor the BHP and thus, detect when the BHP surpasses a predetermined rate threshold (such as an exemplary rate threshold called "$D_1$" that is depicted in FIG. 6) so that the electronics 16 closes the bottom valve 50 upon this occurrence. Similar to the detection of the magnitudes of the CHP or BHP exceeding predetermined pressure thresholds, the use of the CHP time derivative may be beneficial in terms of S/N ratio; and the use of the BHP time derivative may be more beneficial for purposes avoiding the problems that may be associated with long range telemetry between the upper sensor 80 and the electronics 16. Furthermore, as set forth above, instead of the electronics 16 automatically controlling the bottom valve 50 in response to the first order time derivative of the pressure reaching a threshold, the bottom valve 50 may be controlled remotely from the surface of the well. Thus, many variations are possible and are within the scope of the appended claims.

It is noted that in other embodiments of the invention, higher order derivatives or other characteristics of the BHP or CHP may be used for purposes of detecting the optimal time to close the bottom valve 50. Thus, many variations are possible and are within the scope of the appended claims.

Figure 7:
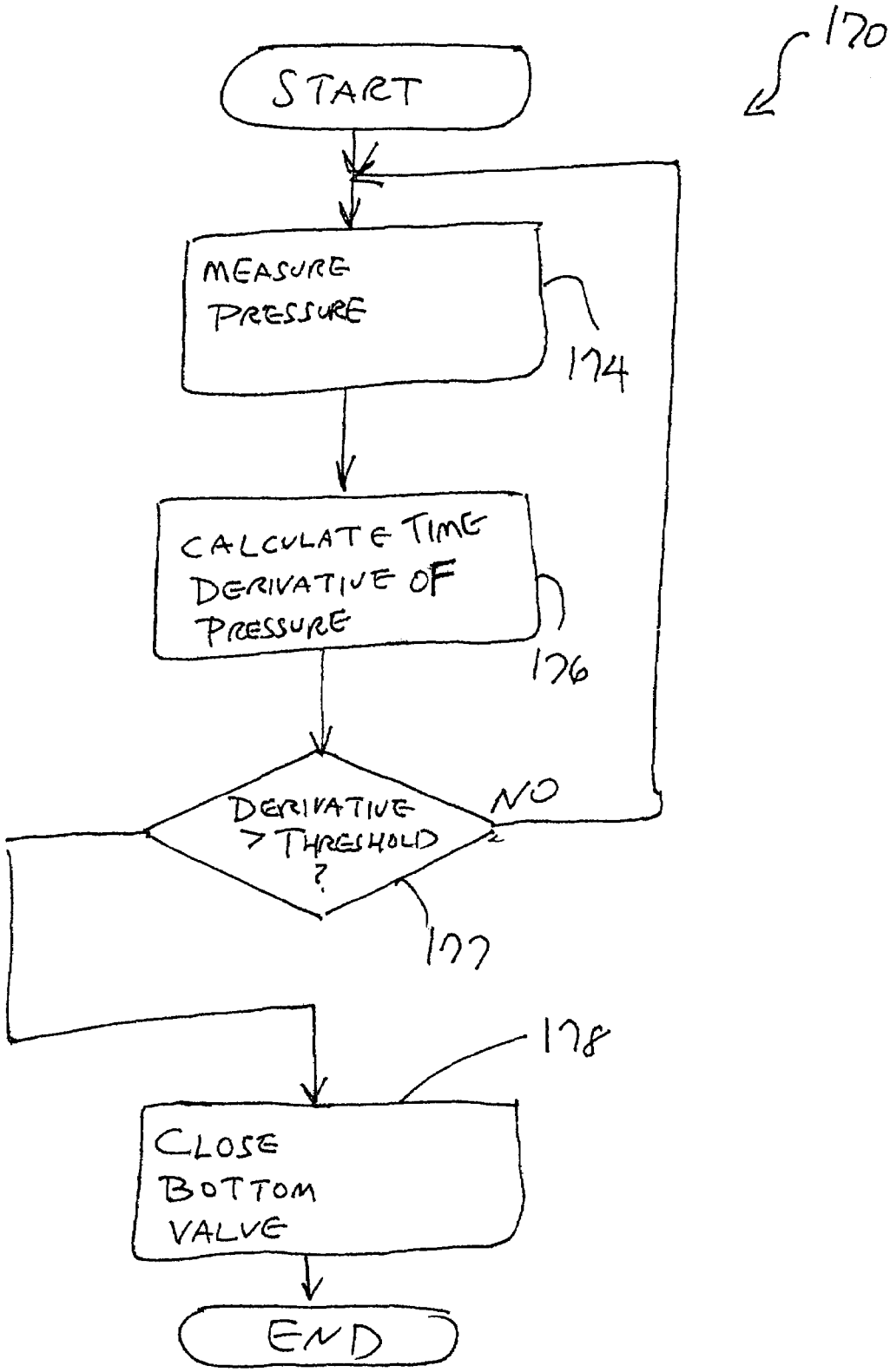
FIG. 7 is a flow diagram depicting a technique to use the time derivative of a measured pressure to time the closing of the bottom valve of the closed chamber testing system according to an embodiment of the invention.

To summarize, a technique 170 that is generally depicted in FIG. 7 may be used in accordance with some embodiments of the invention to determine the optimal time to close the bottom valve 50. Referring to FIG. 7, pursuant to the technique 170, a pressure is measured (block 174), and then a time derivative of the pressure is calculated (block 176). If a determination is made (diamond 177) that the derivative exceeds a predetermined derivative threshold, the bottom valve 50 is closed (block 178). Otherwise, the pressure continues to be measured (block 174), and the derivative continues to be calculated (block 176) until the threshold is reached.

Although, as described above, the optimal time to close the bottom valve 50 may be determined by comparing a pressure magnitude or its time derivative to a threshold, other techniques may be used in other embodiments of the invention using a measured pressure magnitude and/or its time derivative. For example, in other embodiments of the invention, the shape of the pressure waveform or the time derivative waveform (obtained from measurements) may be compared to a predetermined time signature for purposes of detecting a pressure magnitude or rate change that is expected to occur at the optimal closing time (see FIGS. 4 and 6) using what is generally known as a pattern recognition approach. Thus, an error analysis (as an example) may be performed to compare a "match" between a moving window of the pressure magnitude or derivative and an expected pressure magnitude/derivative time signature. When the calculated error falls below a predetermined threshold (as an example), then a match is detected that triggers the closing of the bottom valve 50.

In yet another embodiment of the invention, the measured pressure or its time derivative can be transformed into the frequency domain via a mathematical transformation algorithm, for example, a Fourier Transform or Wavelet Transform, to name a few. The pattern of the transformed data is then compared with the predetermined signature in the frequency domain to detect the arrival of the optimal time during the CCT.

Parameters other than pressure may be monitored to determine the optimal time to close the bottom valve 50 in other embodiments of the invention. For example, a flow rate may be monitored for purposes of determining the optimal time. More specifically, the sandface flow rate decreases to an insignificant magnitude at the optimal time to close the bottom valve 50. For purposes of measuring the flow rate, the bottom sensor 90 may be a downhole flow meter, such as a Venturi device, spinner or any other type of flow meter that uses physical, chemical or nuclear properties of the wellbore fluid.

Figure 8:
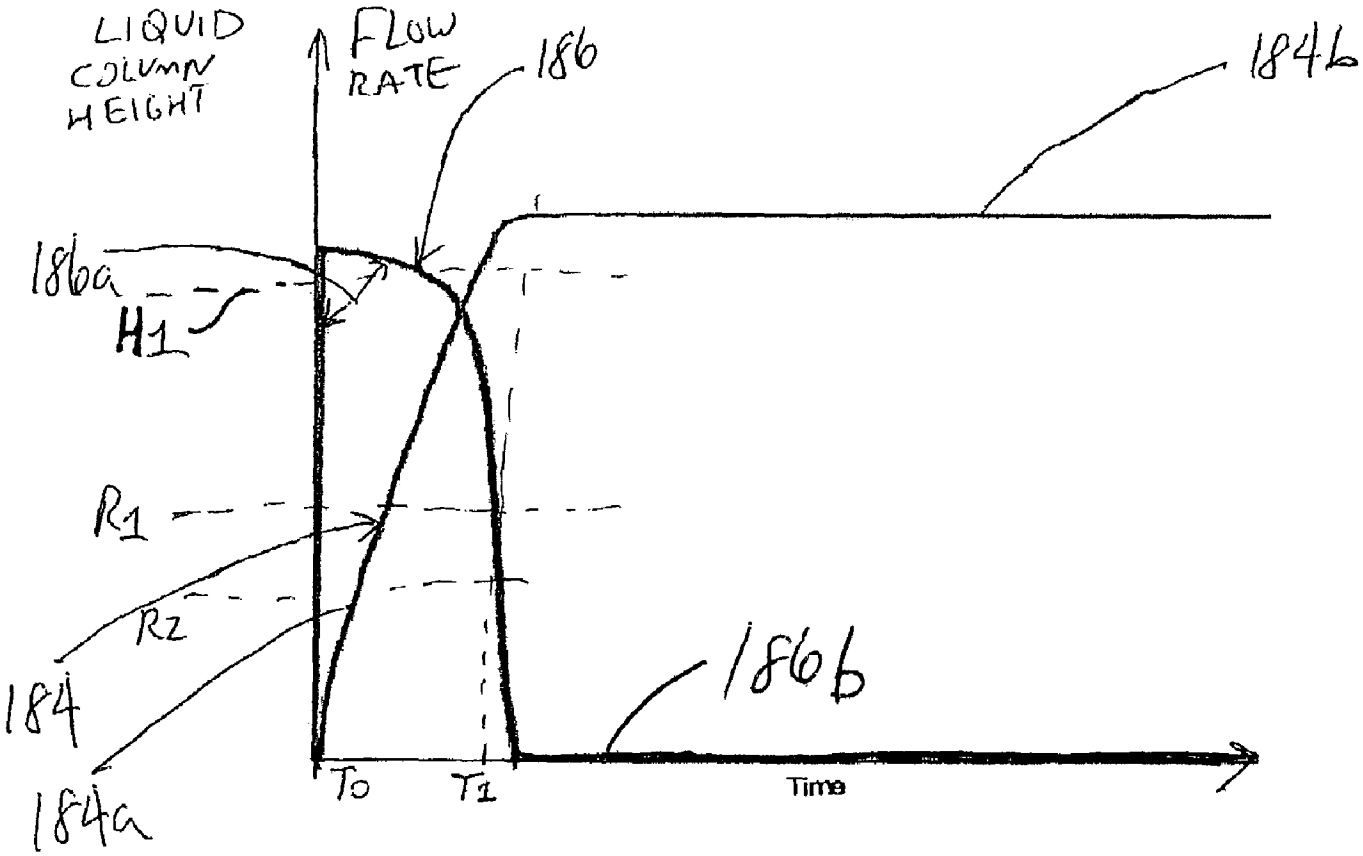
FIG. 8 depicts exemplary liquid column height and flow rate waveforms that may occur in connection with a closed chamber test according to an embodiment of the invention.

FIG. 8 depicts an exemplary flow rate waveform 186 that may be observed during a particular CCT testing operation. Near the beginning of the testing operation when the bottom valve 50 opens at time $T_0$, the flow rate abruptly increases from zero to a maximum value, as shown in the initial abrupt increase in the waveform 186 in a segment 186*a* of the waveform. After this abrupt increase, the flow rate decreases, as illustrated in the remaining part of the segment 186*a* of the waveform 186 from approximately time $T_0$ to time $T_1$. Near time $T_1$, the flow rate abruptly decreases to almost zero flow, as shown in the segment 186*b*. Thus, time $T_1$ is the optimal time for closing the bottom valve 50, as the flow rate experiences an abrupt downturn, indicating the beginning of more significant non-linear gas effects.

Thus, in some embodiments of the invention, the downhole flow rate may be compared to a predetermined rate threshold (such as an exemplary rate threshold called "$R_1$" that is depicted in FIG. 8) for purposes of determining the optimum time to close the bottom valve 50. When the flow rate decreases below the rate threshold, the electronics 16 (for example) responds to close the bottom valve 50. Other flow rate thresholds (such as an exemplary threshold called "$R_2$") may be used in other embodiments of the invention.

In other embodiments of the invention a parameter obtained from the flow rate measurement may be used to determine the optimal time to close the bottom valve 50. For example, the absolute value of the time derivative of the flow rate has a spike, similar to the pressure derivative "spike" shown in FIG. 6. Identifying this spike can also indicate the optimal time to close the bottom valve 50.

Figure 9:
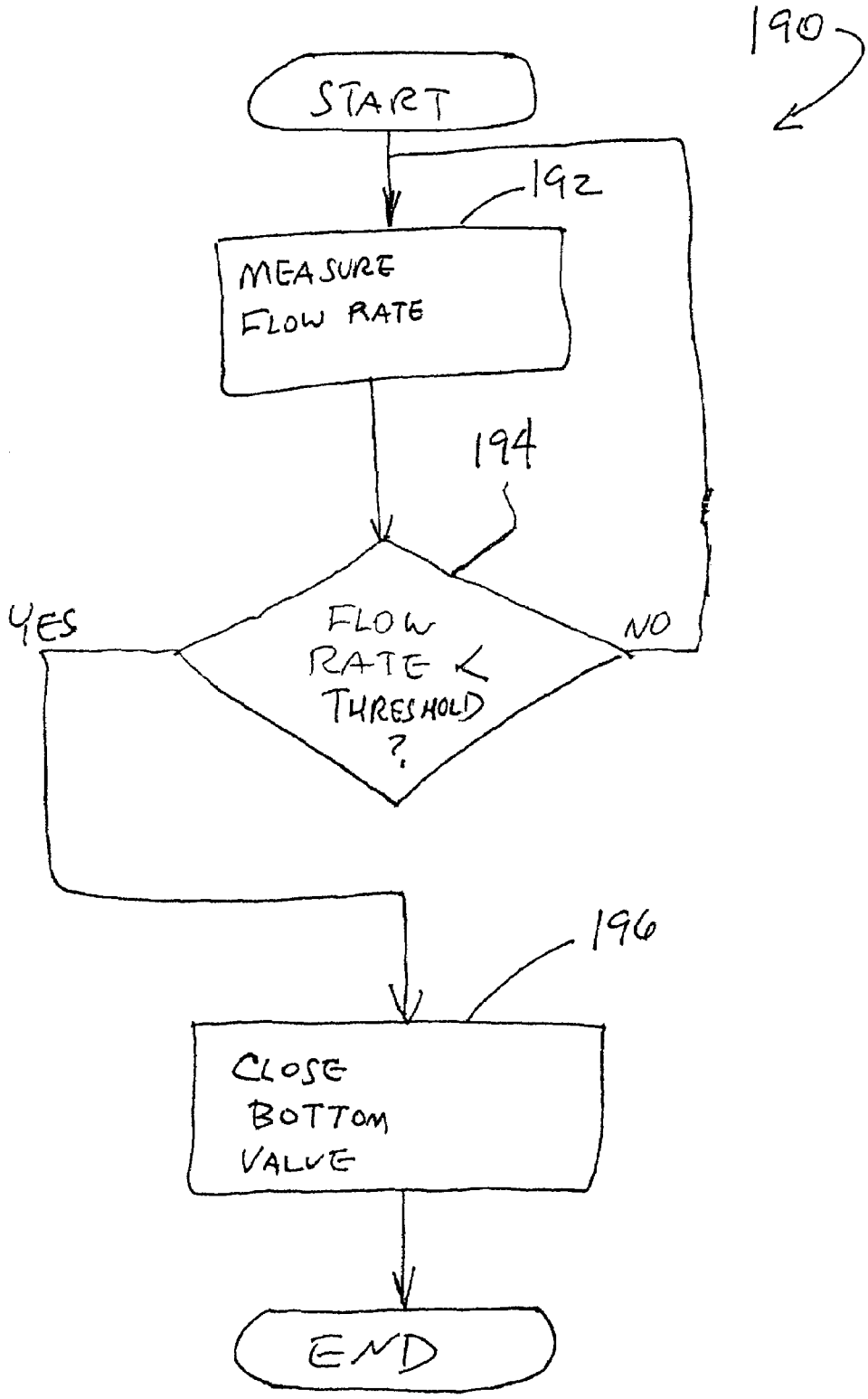
FIG. 9 is a flow diagram depicting a technique to use a measured flow rate to time the closing of the bottom valve of the closed chamber testing system according to an embodiment of the invention.

To summarize, in accordance with some embodiments of the invention, a technique 190 that is generally depicted in FIG. 9 may be used to control the bottom valve 50. Referring to FIG. 9, pursuant to the technique 190, a flow rate is measured (block 192) and then a determination is made (diamond 194) whether the flow rate has decreased below a predetermined rate threshold. If not, then one or more additional measurement(s) are made (block 192) until the flow rate decreases past the threshold (diamond 194). In response to detecting that the flow rate has decreased below the predetermined rate threshold, the bottom valve 52 is closed, as depicted in block 196.

Yet, in another embodiment of the invention, the measured flow rate or its time derivative can be transformed into the frequency domain via a mathematical transformation algorithm, for example, a Fourier Transform or Wavelet Transform, to name a few. The pattern of the transformed data is compared with the predetermined signature in the frequency domain to detect the arrival of the optimal time.

The height of the fluid column inside the chamber 60 is another parameter that may be monitored for purposes of determining the optimal time to close the bottom valve 50, as a specific height indicates the beginning of more significant non-linear gas effects. More specifically, a detectable cushion fluid or wellbore fluid (for example, a special additive in the mud, completion or cushion fluid) is placed in the surge chamber 60 before the testing. Thus, referring back to FIG. 1, this fluid may be the liquid cushion 64, for example. The detectable fluid may be anything that can be detected when it rises to a specified location in the surge chamber 60. At this specified location, the CCT system 10 includes a fluid detector. Thus, in some embodiments of the invention, the upper sensor 80 may be a fluid detector that is located at a predetermined height in the surge chamber 60 to indicate when the detectable fluid reaches the specified height. In other embodiments of the invention, the fluid detector may be separate from the upper sensor 80.

When the liquid column (or other detectable fluid) comes in close proximity to the fluid detector, the detector generates a signal that may be, for example, detected by the electronics 16 for purposes of triggering the closing of the bottom valve 50.

In some embodiments of the invention, physical and chemical properties of the wellbore fluid may be detected for purposes of determining the optimal time to close the bottom valve 50. For example, the density, resistivity, nuclear magnetic response, sonic frequency, etc. of the wellbore fluid may be measured at specified location(s) in the surge chamber 60 (alternatively, anywhere in the tubing 14 above valve 70 or below the valve 50) for the purpose of obtaining the liquid length in the chamber 60 to detect the optimal time to close the bottom valve 50.

Referring back to FIG. 8, FIG. 8 depicts an exemplary waveform 184 of a fluid height in the surge chamber 60, which may be observed during a CCT testing operation. The waveform 184 includes an initial segment 184*a* (between approximately time $T_0$ to time $T_1$) in which the fluid height rises at a greater rate with respect to a latter segment 184*b* (that occurs approximately after time $T_1$) of the waveform 184. The transition between the segments 184*a* and 184*b* occurs at the optimal time $T_1$ (at an exemplary height threshold called "$H_1$") to close the bottom valve 50. In other words, after time T1, the surge chamber 60 cannot hold significantly more produced fluid from the formation, as it has been nearly filled to capacity. Keeping the surge chamber 60 open longer will not significantly increase the volume of the produced formation fluid nor achieve a better clean up. Thus, in accordance with some embodiments of the invention, the electronics 16 monitors the fluid level detector for purposes of detecting a predetermined height in the chamber 60. For example, as shown in FIG. 8, the fluid detector may be located at the $H_1$ height (called for example) so that when the fluid column reaches this height, the fluid detector generates a signal that is detected by the electronics 16; and in response to this detection, the electronics 16 closes the bottom valve 50.

In other embodiments of the invention, the mathematically processed fluid level measured by the sensor 80 may be used to determine the optimal time to close the bottom valve 60. For example, the time derivative of the fluid level has a recognizable signature around the optimal time T1. The bottom valve 50 closes in response to the identification of the signature.

Figure 10:
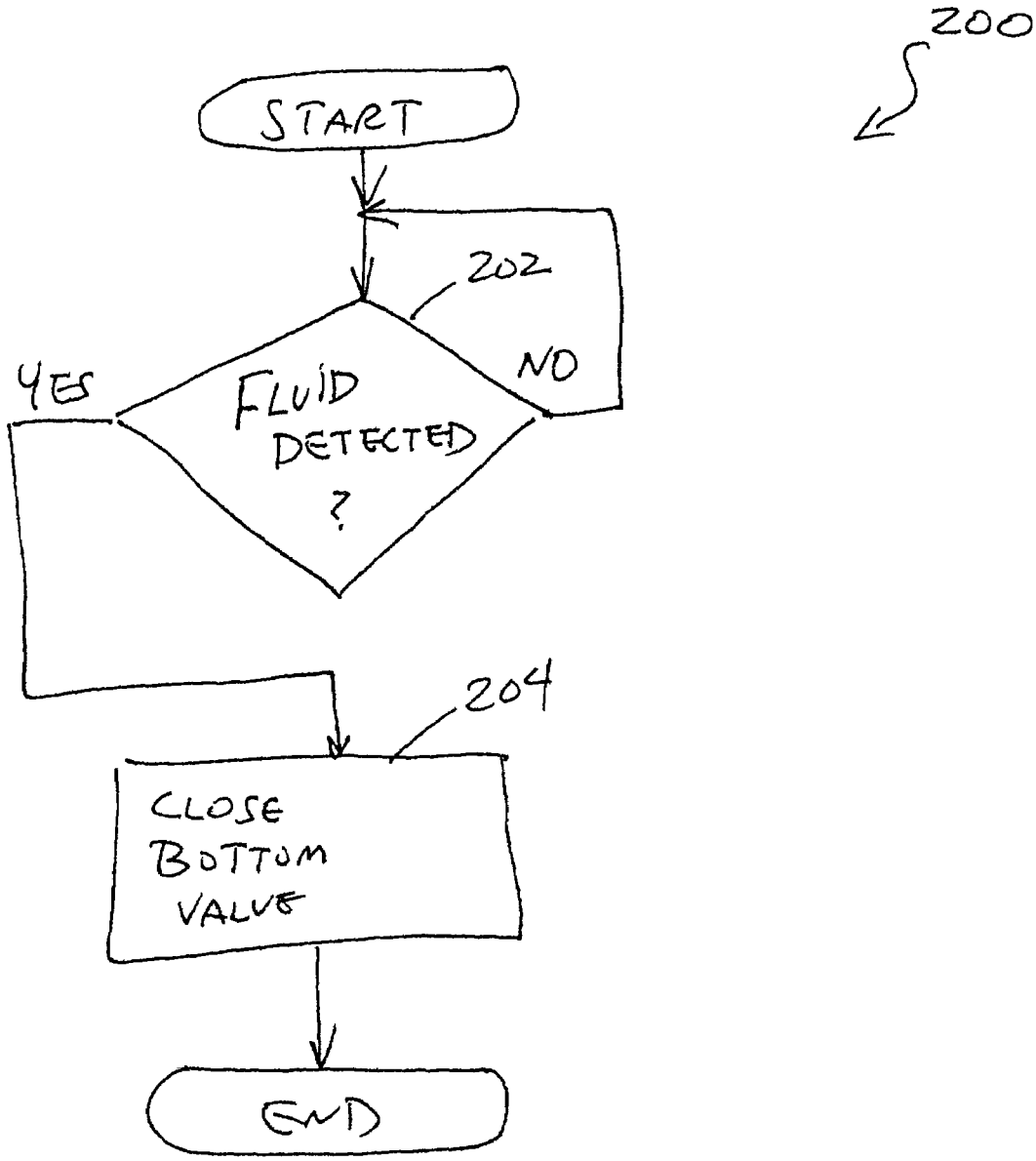
FIG. 10 depicts a technique to use the detection of a particular fluid to time the closing of the bottom valve of the closed chamber testing system according to an embodiment of the invention.

Therefore, to summarize, in accordance with some embodiments of the invention, the CCT system 10 performs a technique 200 that is depicted in FIG. 10. Pursuant to the technique 200, a determination is made (diamond 202) whether the fluid has been detected by the fluid detector. If so, then the bottom valve 50 is closed (block 204).

In yet another embodiment of the invention, the measured fluid height or its time derivative may be transformed into the frequency domain via a mathematical transformation algorithm, for example, a Fourier Transform or Wavelet Transform, to name a few. The pattern of the transformed data is compared with the predetermined signature in the frequency domain to detect the arrival of the optimal time during the CCT.

Figure 11:
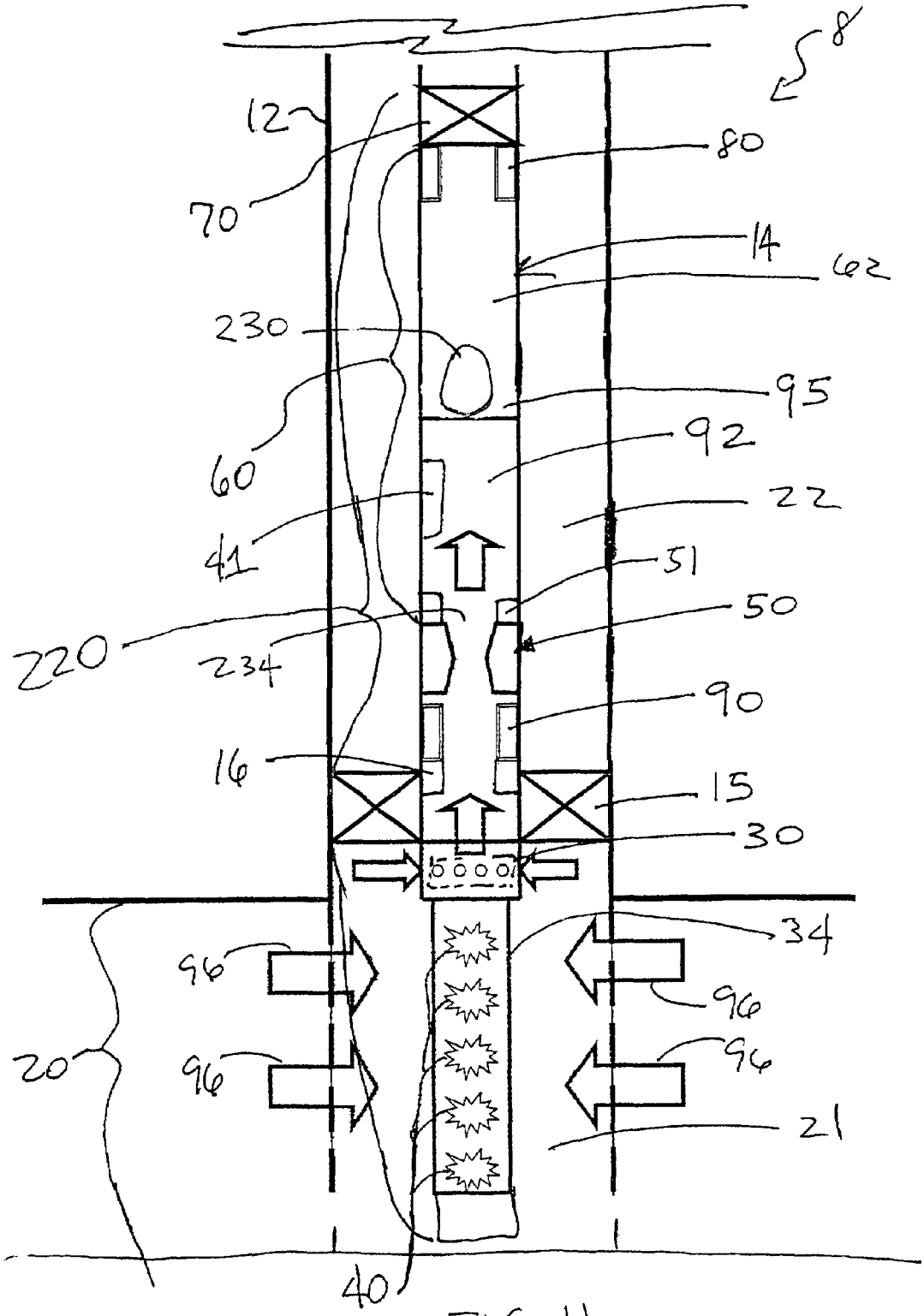
FIG. 11 is a schematic diagram of a closed chamber testing system that includes a mechanical object to time the closing of the bottom valve of the system according to an embodiment of the invention.

Referring to FIG. 11, a CCT system 220 may be used in place of the CCT system 10, in other embodiments of the invention. The CCT system 220 has a similar design to the CCT system 10, with common elements being denoted in FIG. 11 by the same reference numerals used in FIGS. 1 and 2. Unlike the CCT system 10, the CCT system 220 includes a mechanical object, such as a ball 230, that is located inside the surge chamber 60 for purposes of forming a system to detect the height of the liquid column inside the chamber 60. Thus, as a more specific example, the ball 230 may be located on top of the liquid cushion layer 64 (see FIG. 1) prior to the opening of the bottom valve 50 to begin the closed chamber test. Alternatively, in some embodiments of the invention in which a liquid cushion layer 64 is not present, the ball 230 may rest on a seat 234 of the bottom valve 50. Thus, many variations are possible and are within the scope of the appended claims.

The ball 230 has a physical property that is detectable by a sensor (such as the upper sensor 80, for example) that is located inside the chamber 60 for purposes of determining when the liquid column reaches a certain height. For example, in some embodiments of the invention, the upper sensor 80 may be a coil that generates a magnetic field, and the ball 230 may be a metallic ball that affects the magnetic field of the coil. Thus, when the ball 230 comes into proximity to the coil, the coil generates a waveform that is indicative of the liquid column reaching a specified height.

In another embodiment of this invention, the velocity of the ball 230 may be used to determine the optimal time to close the bottom valve 50. The velocity of the ball 230 may be measured via sensor 80 using, for example, an acoustic apparatus. When the liquid column approaches its highest level, due to considerable gas compression, the velocity of ball 230 significantly reduces to nearly zero. When the velocity of the ball 230 is below a predetermined value, the bottom-valve 50 may be signaled to close.

Figure 12:
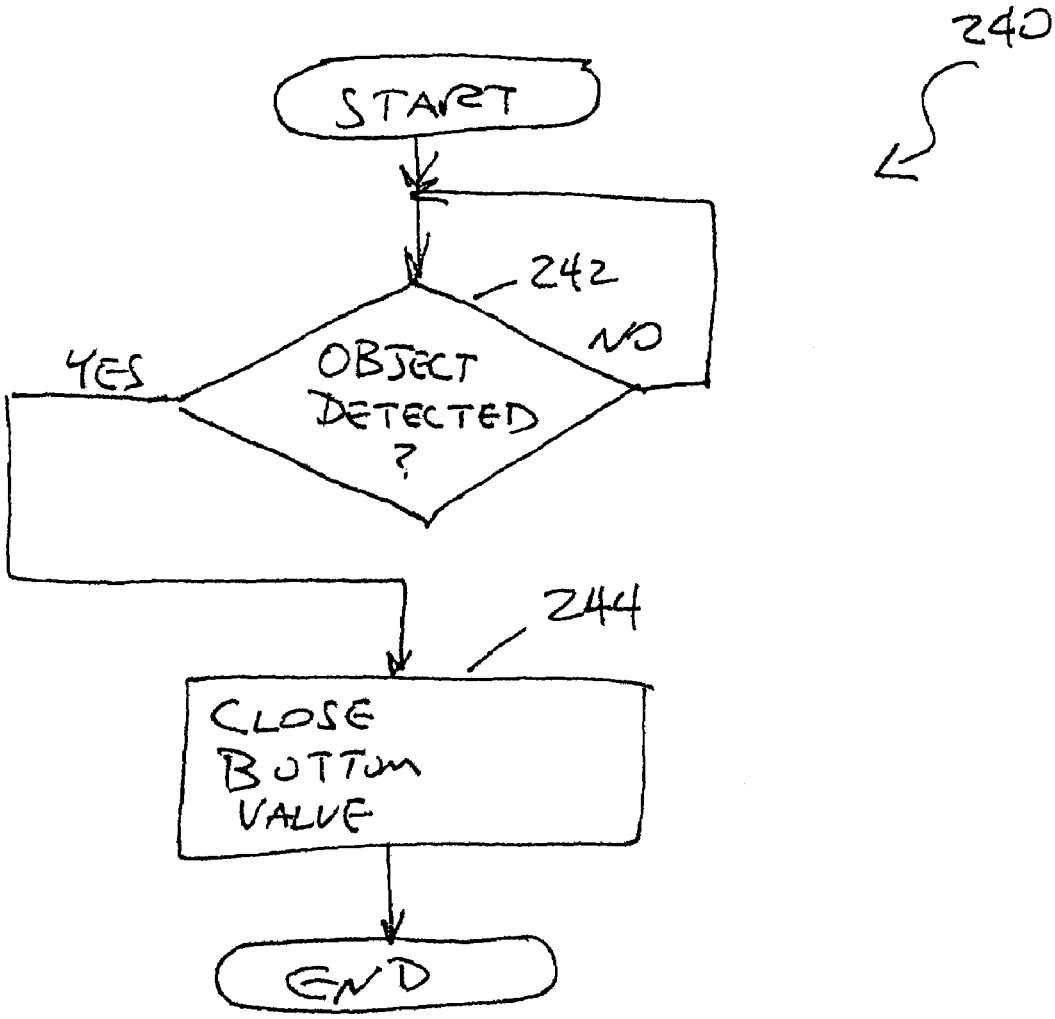
FIG. 12 is a flow diagram depicting a technique to use a mechanical object to time the closing of the bottom valve of a closed chamber testing system according to an embodiment of the invention.

To summarize, in accordance with some embodiments of the invention, a technique 240 that is generally depicted in FIG. 12 includes determining (diamond 242) whether a mechanical object has been detected at a predetermined location in the surge chamber 60, and if so, the bottom valve 50 is closed in response to this detection, as depicted in block 244.

In yet another embodiment of the invention, the measured velocity of the ball or its time derivative may be transformed into the frequency domain via a mathematical transformation algorithm, for example, a Fourier Transform or Wavelet Transform, to name a few. The pattern of the transformed data is compared with the predetermined signature in the frequency domain to detect the arrival of the optimal time during the CCT.

In some embodiments of the invention, a moveable pig may be used for purposes of detecting the optimal time to close the lower valve 50. For example, a liquid cushion fluid may exist above the ball 230. In this situation, the liquid cushion may partially fill the surge chamber 60, completely fill it, or completely fill the tubular string between the ball 230 and the surface of the well. In the two latter cases, the ball 230 separates the fluid below and above the ball, and the upper valve 70 is open to allow formation fluid below the ball 230 to move up along the tubular when the lower valve 50 is open. Because the movement of the ball 230 is restricted within the length of the tubular string, even when the upper valve 70 is open, the total amount of produced fluid from the formation is still limited to the maximum length of passage of the ball 230. All previously-mentioned characteristics that are related to the optimal closing time of the lower valve 50, including pressure, pressure derivative, flow rate, liquid column height, the location or speed of the mechanical object etc may be used alone or in some combination to determine the optimal time to close the bottom valve 50.

In some embodiments of the invention, fluid below the ball 230 may pass through the ball 230 to the space above the ball 230 after the ball 230 reaches the end of the passage channel 14. In this situation, the well testing system 8 may not restrict the produced formation fluid into a fixed volume. Because there is a transition stage between the ball 230 moving up and the fluid passing through the ball 230 after it stops, many of the measured properties using the sensors 80 and/or 90 show the similar characteristics of the closed system when the transition stage starts. Therefore, the aforementioned techniques can be applied to all these situations, which are within the scope of the appended claims.

Figure 13:
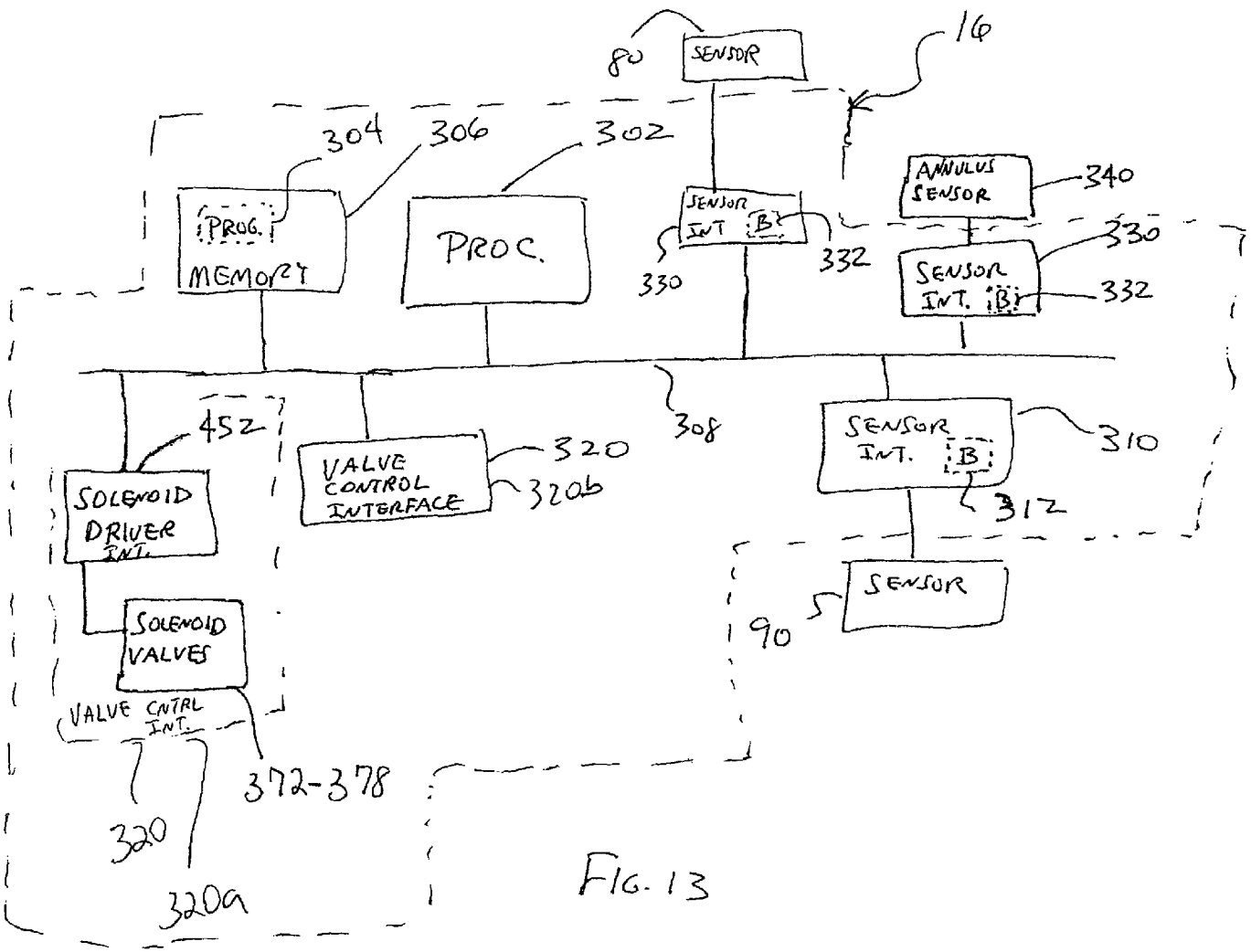
FIG. 13 is a schematic diagram of the electrical system of the closed chamber testing system according to an embodiment of the invention.

The electronics 16 may have a variety of different architectures, one of which is depicted for purposes of example in FIG. 13. Referring to FIG. 13, the architecture includes a processor 302 (one or more microprocessors or microcontrollers, as examples) that is coupled to a system bus 308. The processor 302 may, for example, execute program instructions 304 that are stored in a memory 306. Thus, by executing the program instructions 304, the processor 302 may perform one or more of the techniques that are disclosed herein for purposes of determining the optimal time to close the bottom valve 50 as well as taking the appropriate measures to close the valve 50.

In some embodiments of the invention, the lower 90 and upper 80 sensors may be coupled to the system bus 308 by sensor interfaces 310 and 330, respectively. The sensor interfaces 310 and 330 may include buffers 312 and 332, respectively, to store signal data that is provided by the lower sensor 90 and upper sensor 80, respectively. In some embodiments of the invention, the sensor interfaces 310 and 330 may include analog-to-digital converters (ADCs) to convert analog signals into digital data for storage in the buffers 312 and 332. Furthermore, in some embodiments of the invention, the sensor interface 330 may include long range telemetry circuitry for purposes of communicating with the upper sensor 80.

The electronics 16 may include various valve control interfaces 320 (interfaces 320*a* and 320*b*, depicted as examples) that are coupled to the system bus 308. The valve control interfaces 320 may be controlled by the processor 302 for purposes of selectively actuating the upper valve 70 and bottom valve 50. The valve control interface 320*a* may control the bottom valve 50; and the valve control interface 320*b* may control the upper valve 70. Thus, for example, the processor 302 may communicate with the valve control interface 320*a* for purposes of opening the bottom valve 50 to begin the closed chamber test; and the processor 302 may, in response to detecting the optimal time, communicate with the valve control interface 320*a* to close the bottom valve 50.

In accordance with some embodiments of the invention, each valve control interface 320 (i.e., either interface) includes a solenoid driver interface 452 that controls solenoid valves 372-378, for purposes of controlling the associated valve. The solenoid valves 372-378 control hydraulics 400 (see FIG. 14) of the associated valve, in some embodiments of the invention. The valve control interfaces 320*a* and 320*b* may be substantially identical in some embodiments of the invention.

In some embodiments of the invention, the valve control interface 320*a* may be used in the control of the bottom valve 50, and the valve control interface 320*b* may be used in the control of the upper valve 70. In some embodiments of the invention the valve interface 320*b* may include long range telemetry circuit for purposes of communicating with the upper valve 70 and the interface may be physically located apart from the upper valve 70.

Figure 14:
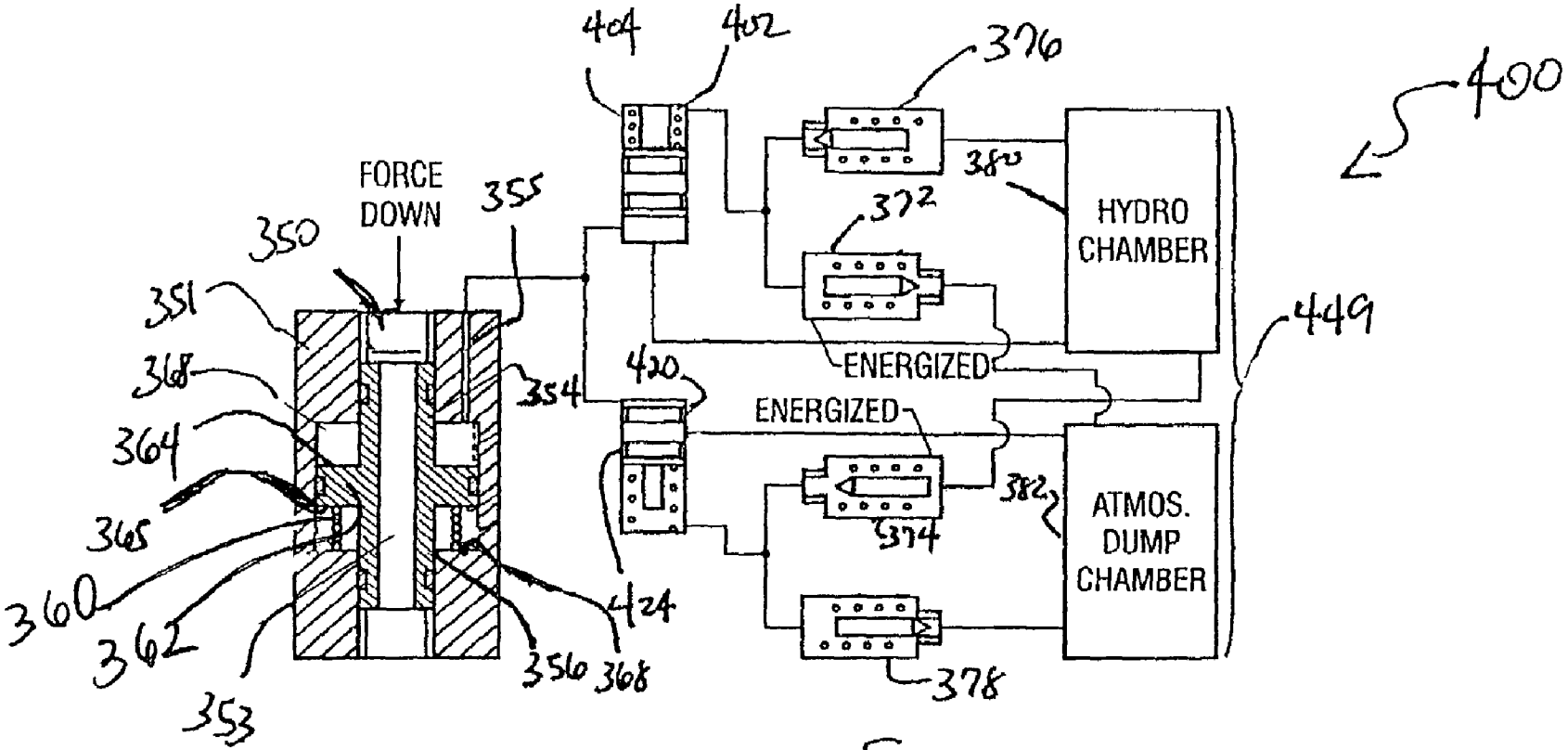
FIG. 14 is a block diagram depicting a hydraulic system to control a valve of the closed chamber testing system according to an embodiment of the invention.

Referring to FIG. 14 to illustrate a possible embodiment of the control hydraulics 400 (although many other embodiments are possible and are within the scope of the appended claims), each valve uses a hydraulically operated tubular member 356 which through its longitudinal movement, opens and closes the valve. The tubular member 356 may be slidably mounted inside a tubular housing 351 of the CCT system. The tubular member 356 includes a tubular mandrel 354 that has a central passageway 353, which is coaxial with a central passageway 350 of the tubular housing 351. The tubular member 356 also has an annular piston 362, which radially extends from the exterior surface of the mandrel 354. The piston 362 resides inside a chamber 368 that is formed in the tubular housing 351.

The tubular member 356 is forced up and down by using a port 355 in the tubular housing 351 to change the force applied to an upper face 364 of the piston 362. Through the port 355, the face 364 is subjected to either a hydrostatic pressure (a pressure greater than atmospheric pressure) or to atmospheric pressure. A compressed coiled spring 360, which contacts a lower face 365 of the piston 362, exerts upward forces on the piston 362. When the upper face 364 is subject to atmospheric pressure, the spring 360 forces the tubular member 356 upward. When the upper face 364 is subject to hydrostatic pressure, the piston 362 is forced downward.

The pressures on the upper face 364 are established by connecting the port 355 to either a hydrostatic chamber 380 (furnishing hydrostatic pressure) or an atmospheric dump chamber 382 (furnishing atmospheric pressure). The four solenoid valves 372-378 and two pilot valves 404 and 420 are used to selectively establish fluid communication between the chambers 380 and 382 and the port 355.

The pilot valve 404 controls fluid communication between the hydrostatic chamber 380 and the port 355; and the pilot valve 420 controls fluid communication between the atmospheric dump chamber 382 and the port 355. The pilot valves 404 and 420 are operated by the application of hydrostatic and atmospheric pressure to control ports 402 (pilot valve 404) and 424 (pilot valve 420). When hydrostatic pressure is applied to the port 355 the valve shifts to its down position and likewise, when the hydrostatic position is removed, the valve shifts to its upper position. The upper position of the valve is associated with a particular state (complementary states, such as open or closed) of the valve, and the lower position is associated with the complementary state, in some embodiments of the invention.

It is assumed herein, for purposes of example, that the valve is closed when hydrostatic pressure is applied to the port 355 and open when atmospheric pressure is applied to the port 355, although the states of the valve may be reversed for these port pressures, in other embodiments of the invention.

The solenoid valve 376 controls fluid communication between the hydrostatic chamber 380 and the control port 402. When the solenoid valve 376 is energized, fluid communication is established between the hydrostatic chamber 380 and the control port 402, thereby closing the pilot valve 404. The solenoid valve 372 controls fluid communication between the atmospheric dump chamber 382 and the control port 402. When the solenoid valve 372 is energized, fluid communication is established between the atmospheric dump chamber 382 and the control port 402, thereby opening the pilot valve 404.

The solenoid valve 374 controls fluid communication between the hydrostatic chamber 380 and the control port 424. When the solenoid valve 374 is energized, fluid communication is established between the hydrostatic chamber 380 and the control port 424, thereby closing the pilot valve 420. The solenoid valve 378 controls fluid communication between the atmospheric dump chamber 382 and the control port 424. When the solenoid valve 378 is energized, fluid communication is established between the atmospheric dump chamber 382 and the control port 424, thereby opening the pilot valve 420.

Thus, to force the moving member 356 downward, (which opens the valve) the electronics 16 (i.e., the processor 302 (FIG. 13) by its interaction with the solenoid driver interface 452 of the CCT system energize the solenoid valves 372 and 374. To force the tubular member 356 upward (which closes the valve), the electronics 16 energizes the solenoid valves 376 and 378. Various aspects of the valve hydraulics in accordance with the many different possible embodiments of the invention are further described in U.S. Pat. No. 4,915,168, entitled "MULTIPLE WELL TOOL CONTROL SYSTEMS IN A MULTI-VALVE WELL TESTING SYSTEM," which issued on Apr. 10, 1990, and U.S. Pat. No. 6,173,772, entitled "CONTROLLING MULTIPLE DOWNHOLE TOOLS," which issued on Jan. 16, 2001.

Other embodiments are within the scope of the appended claims. For example, referring back to FIG. 13, in some embodiments of the invention, the electronics 16 may be coupled to an annulus sensor 340 (of the CCT system) that is located above the packer 15 (see FIG. 1) for purposes of receiving command-encoded fluid stimuli that are communicated downhole (from the surface of the well 8) through the annulus 22. Thus, the electronics 16 may include a sensor interface 330 that is coupled to the annulus sensor 340, and the sensor interface 330 may, for example, include an ADC as well as a buffer 332 to store data provided by the sensor's output signal.

Therefore, in some embodiments of the invention, command-encoded stimuli may be communicated to the CCT system from the surface of the well for such purposes of selectively opening and closing the upper 70 and/or bottom 50 valves, as well as controlling other valves and/or different devices, depending on the particular embodiment of the invention.

As an example of yet another embodiment of the invention, referring back to FIG. 2, it is noted that if desired, produced formation fluid may be forced back into the formation or other subterranean formation by injecting a working fluid through tubing 14 using a surface pump rather than circulating it out to the surface. In this situation, zero emission of hydrocarbons is maintained during the CCT. In another implementation of the technique, the injection of a working fluid into the formation may be continuous for a prolonged time, after which the bottom valve 50 is shut in to conduct a so-called injection and fall-off test.

Although a liquid formation fluid is described above, the techniques and systems that are described herein may likewise be applied to gas or gas condensate reservoirs. For example, the flow rate may be used to identify the optimal closing time of the bottom valve 50 for gas formation testing.

While the terms of orientation and direction, such as "upper," "lower," "bottom," "upstream," etc., have been used herein to describe certain embodiments of the invention, it is understood that the invention is not to be limited to these specified orientations and directions. For example, in other embodiments of the invention, the CCT system may be used to conduct a CCT inside a lateral wellbore. Thus, many variations are possible and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method usable with a well, comprising:

communicating fluid from the well into a downhole chamber in connection with a well test;

monitoring a downhole pressure parameter responsive to the communication of the fluid to determine when to close the chamber; and closing the chamber in response to the monitoring, comprising isolating the chamber from a bottom hole pressure in the well.

2. The method of claim 1, wherein at least one of the determination of when to close the chamber and the act of monitoring occurs remotely from a surface of the well.

3. The method of claim 1, wherein at least one of the act of monitoring and the determination of when to close the chamber occurs entirely downhole in the well.

4. The method of claim 1, wherein the act of closing the chamber occurs in response to at least one of the following:

a predetermined magnitude of the pressure parameter; a predetermined value of a mathematical transform of the pressure parameter; a time signature of the pressure parameter; a frequency signature of the pressure parameter; a time signature of a mathematical transform of the pressure parameter; and a frequency signature of a mathematical transform of the pressure parameter.

5. The method of claim 1, wherein the act of closing the chamber comprises closing a downhole valve in response to the act of monitoring.

6. The method of claim 1, wherein the act of closing the chamber occurs in response to expiration of a predetermined time interval.

7. The method of claim 1, wherein the act of closing occurs in response to the detection of at least one of said fluid and at least one other fluid.

8. The method of claim 1, wherein the act of closing occurs in response to a time rate of change of the pressure parameter exceeding a predetermined threshold.

9. The method of claim 1, wherein the pressure parameter comprises one of a pressure in the chamber and a pressure upstream of the chamber.

10. The method of claim 1, wherein the act of closing occurs in response to a magnitude of the pressure parameter exceeding a predetermined limit.

11. The method of claim 10, wherein the pressure parameter comprises one of a pressure in the chamber and a pressure upstream of the chamber.

12. The method of claim 1, wherein the act of closing occurs in response to at least one of the following:

a time signature of the pressure parameter substantially matching a predetermined time signature;

a frequency signature of the pressure parameter substantially matching a predetermined frequency signature;

a time signature of a time rate of change of the pressure parameter substantially matching a predetermined signature; and a frequency signature of a time rate of change of the pressure parameter substantially matching a predetermined signature.

13. The method of claim 1, wherein the act of closing comprises closing the chamber in response to a column of fluid inside the chamber reaching a predetermined height.

14. The method of claim 1, wherein the act of closing comprises closing the chamber in response to a volume of fluid inside the chamber reaching a predetermined value.

15. The method of claim 1, wherein the pressure parameter indicates one of a pressure property of the fluid and a pressure property of another fluid affected by the communication.

16. A method usable with a well, comprising:

communicating fluid from the well into a downhole chamber in connection with a well test;

monitoring a downhole parameter responsive to the communication of the fluid to determine when to close the chamber; and closing the chamber in response to the monitoring, comprising isolating the chamber from a bottom hole pressure in the well wherein the parameter comprises an indication of at least one of the following:

whether a mechanical object moved by the flow has reached a predetermined height in the chamber; whether a time signature of the movement of a mechanical object substantially matches a predetermined pattern; whether a frequency signature of the movement of a mechanical object substantially matches a predetermined pattern;

whether a velocity of the mechanical object has reached a predetermined value; whether a time signature of a velocity of a mechanical object substantially matches a predetermined pattern; whether a frequency signature of a velocity of a mechanical object substantially matches a predetermined pattern; whether a time rate of change of the velocity of a mechanical object has reached a predetermined value; whether a time signature of a time rate of change of the velocity of the mechanical object substantially matches a predetermined pattern; and whether a frequency signature of a time rate of change of the velocity of the mechanical object substantially matches a predetermined pattern.

17. The method of claim 1, wherein the pressure parameter comprises an indication of a flow rate of the fluid.

18. The method of claim 1, wherein the pressure parameter comprises an indication of a pressure near an upper end of the chamber.

19. The method of claim 1, wherein the pressure parameter comprises an indication of a pressure near a bottom end of the chamber.

20. The method of claim 1, wherein the well testing operation comprises a closed chamber testing operation.

21. A system usable with a well, comprising:

a tubular member including a chamber;

a valve disposed in the tubular member to control fluid flow from the well into the chamber in connection with a well testing operation; and a circuit to receive an indication of a measurement of a downhole pressure parameter responsive to the fluid flow and to control the valve to selectively close the valve in response to the measurement to isolate the chamber from a bottom hole pressure in the well.

22. A system usable with a well, comprising:

a tubular member including a chamber;

a valve disposed in the tubular member to control fluid flow from the well into the chamber in connection with a well testing operation; and a circuit to receive an indication of a measurement of a downhole parameter responsive to the fluid flow and control the valve to selectively close the valve in response to the measurement to isolate the chamber from a bottom hole pressure in the well wherein the valve is located near a lower end of the chamber and the system further comprises:

another valve located near an upper end of the chamber.

23. The system of claim 22, wherein the circuit closes the valve in response to at least one of the following:

a predetermined magnitude of the parameter; a predetermined value of a mathematical transform of the parameter; a time signature of the parameter; a frequency signature of the parameter; a time signature of a mathematical transform of the parameter; and a frequency signature of a mathematical transform of the parameter.

24. The system of claim 22, wherein the parameter indicates one of a property of the fluid and a property of another fluid affected by the communication.

25. The system of claim 22, further comprising a mechanical object disposed in the chamber to be moved by the flow, wherein the parameter comprises an indication of at least one of the following:

whether the mechanical object has reached a predetermined height in the chamber; whether a time signature of the movement of a mechanical object substantially matches a predetermined pattern; whether a frequency signature of the movement of a mechanical object substantially matches a predetermined pattern; whether a velocity of the mechanical object has reached a predetermined value; whether a time signature of a velocity of a mechanical object substantially matches a predetermined pattern; whether a frequency signature of a velocity of a mechanical object substantially matches a predetermined pattern; whether a time rate of change of the velocity of the mechanical object has reached a predetermined value; whether a time signature of a time rate of change of the velocity of the mechanical object substantially matches a predetermined pattern; and whether a frequency signature of a time rate of change of the velocity of the mechanical object substantially matches a predetermined pattern.

26. The system of claim 22, wherein the parameter comprises an indication of a flow rate of the fluid, and the circuit closes the valve in response to at least one of the following:

a magnitude of the flow rate being below a predetermined threshold;

a time signature of the flow rate substantially matching a predetermined pattern;

a frequency signature of the flow rate substantially matching a predetermined pattern;

a time rate of change of the flow rate reaching a predetermined threshold;

a time signature of a time rate of change of the flow rate substantially matching a predetermined pattern; and a frequency signature of the time rate of change of the flow rate substantially matching a predetermined frequency pattern.

27. The system of claim 22, wherein the circuit closes the valve in response to one of a set consisting of essentially the following:

a column of the fluid inside the chamber reaching a predetermined height;

a time signature of the column height of the fluid inside the chamber substantially matching a predetermined pattern;

a frequency signature of the column height of the fluid inside the chamber substantially matching a predetermined pattern;

a time rate of change of the column of the fluid inside the chamber exceeding a predetermined threshold;

a time signature of a time rate of change of the column of the fluid inside the chamber substantially matching a predetermined pattern; and a frequency signature of the time rate of change of the column of the fluid inside the chamber substantially matching a predetermined frequency pattern.

28. The system of claim 22, wherein the parameter indicates a pressure in the chamber, and the circuit closes the valve in response to one of a time rate of change of the pressure exceeding a predetermined threshold, a time signature of a time rate of change of the pressure substantially matching a predetermined pattern; and a frequency signature of the time rate of change of the pressure substantially matching a predetermined frequency pattern.

29. The system of claim 22, wherein the parameter indicates a pressure, and the circuit closes the valve in response to at least one of the following:

a magnitude of the pressure exceeding a predetermined threshold;

a time signature of the pressure substantially matching a predetermined pattern;

a frequency signature of the pressure substantially matching a predetermined pattern;

a time rate of change of the pressure exceeding a predetermine threshold;

a time signature of a time rate of change of the pressure substantially matching a predetermined pattern; and a frequency signature of the time rate of change of the pressure substantially matching a predetermined frequency pattern.

30. The system of claim 22, wherein the parameter indicates a pressure in the chamber, and the circuit closes the valve in response to a magnitude of the pressure exceeding a predetermined threshold.

31. The system of claim 22, wherein the parameter indicates a pressure upstream of the chamber, and the circuit closes the valve in response to a magnitude of the pressure exceeding a predetermined threshold.

32. The system of claim 22, wherein the well testing operation comprises a closed chamber testing operation.

* * * * *